US012618639B2

(12) United States Patent
Svenby et al.

(10) Patent No.: US 12,618,639 B2
(45) Date of Patent: May 5, 2026

(54) GRIPS FOR HANDHELD PROJECTILE WEAPONS, HANDHELD PROJECTILE WEAPONS THAT INCLUDE THE GRIPS, AND ASSOCIATED METHODS

(71) Applicant: Kinetic Spearfishing, LLC, Austin, TX (US)

(72) Inventors: Derrick Svenby, Austin, TX (US); Joseph Kutach, Austin, TX (US)

(73) Assignee: Kinetic Spearfishing, LLC, Austin, TX (US)

( * ) Notice: Subject to any disclaimer, the term of this patent is extended or adjusted under 35 U.S.C. 154(b) by 0 days.

(21) Appl. No.: 18/958,231

(22) Filed: Nov. 25, 2024

(65) Prior Publication Data

US 2025/0180325 A1 Jun. 5, 2025

Related U.S. Application Data

(60) Provisional application No. 63/606,295, filed on Dec. 5, 2023.

(51) Int. Cl.
*F41C 23/10* (2006.01)
*F41C 23/16* (2006.01)

(52) U.S. Cl.
CPC ..... *F41C 23/10* (2013.01); *F41C 23/16* (2013.01)

(58) Field of Classification Search
CPC ..... F41C 23/10; F41C 23/16
See application file for complete search history.

(56) References Cited

U.S. PATENT DOCUMENTS

| | | | | |
|---|---|---|---|---|
| 6,112,446 | A * | 9/2000 | Forster | F41C 23/10 42/74 |
| 9,777,984 | B1 * | 10/2017 | Bonine | F41C 23/10 |
| 11,624,571 | B1 * | 4/2023 | Kim | F41A 3/66 42/16 |
| 2010/0212202 | A1 * | 8/2010 | Roth | F41C 23/10 42/71.01 |
| 2016/0202018 | A1 * | 7/2016 | Bruhns | F41C 23/22 42/71.01 |

* cited by examiner

*Primary Examiner* — J. Woodrow Eldred
(74) *Attorney, Agent, or Firm* — Kolitch Romano Dascenzo Gates LLP

(57) ABSTRACT

Grips for handheld projectile weapons, handheld projectile weapons that include the grips, and related methods. The grips include a grip frame, a frame cover, and a fastener. The grip frame includes a frame keyed region, a frame fastener receptacle, and an attachment structure. The frame cover is configured to be operatively attached to the grip frame, to cover a corresponding region of the grip frame, and to at least partially define a grip surface of the grip. The frame cover includes a cover keyed region, which is shaped to slidingly engage with the frame keyed region along an engagement axis. The frame cover also includes a cover fastener receptacle positioned to align with the frame fastener receptacle. The fastener extends through both the frame fastener receptacle and the cover fastener receptacle to resist relative motion between the grip frame and the frame cover.

20 Claims, 20 Drawing Sheets

GRIPS FOR HANDHELD PROJECTILE WEAPONS, HANDHELD PROJECTILE WEAPONS THAT INCLUDE THE GRIPS, AND ASSOCIATED METHODS

RELATED APPLICATION

This application claims priority to U.S. Provisional Patent Application Ser. No. 63/606,295, which was filed on Dec. 5, 2023, and the complete disclosure of which is hereby incorporated by reference.

FIELD OF THE DISCLOSURE

The present disclosure is related generally to grips for handheld projectile weapons, handheld projectile weapons that include the grips, and related methods.

BACKGROUND OF THE DISCLOSURE

Handheld projectile weapons may include one or more grips, which may be configured to be held, gripped, and/or grasped by a user of the handheld projectile weapon during operative use of the handheld projectile weapon to fire a projectile. In some instances, these grips are designed to be replaced and/or reconfigured, such as to permit the grips to be configured to the user's preferences. However, reconfiguring grips in the field can be problematic. As an example, reconfiguring a grip may be difficult for a user to perform, particularly when it is necessary to insert, align, and/or tighten fasteners. As another example, the fasteners easily may be lost in the field. As yet another example, a user may not always be aware when a grip is loose, such as when one or more corresponding fasteners become loose. In addition, currently available grips may not provide an optimal gripping surface for certain conditions. Thus, there exists a need for improved grips for handheld projectile weapons, handheld projectile weapons that include the grips, and/or associated methods.

SUMMARY OF THE DISCLOSURE

Grips for handheld projectile weapons, handheld projectile weapons that include the grips, and related methods are disclosed herein. The grips include a grip frame, a frame cover, and a fastener. The grip frame includes a frame keyed region, a frame fastener receptacle, and an attachment structure. The attachment structure is configured to facilitate attachment of the grip frame to the handheld projectile weapon. The frame cover is configured to be operatively attached to the grip frame, to cover a corresponding region of the grip frame, and to at least partially define a gripping surface of the grip. The grip is shaped to be held by a user of the handheld projectile weapon. The frame cover includes a cover keyed region, which is shaped to slidingly engage with the frame keyed region along an engagement axis and to resist separation of the frame cover from the grip frame in any direction that is not parallel to the engagement axis. The frame cover also includes a cover fastener receptacle positioned to align with the frame fastener receptacle while the cover keyed region is slidingly engaged with the frame keyed region. The fastener extends through both the frame fastener receptacle and the cover fastener receptacle to resist relative motion between the grip frame and the frame cover.

The methods include aligning a cover keyed region of a frame cover of the grip with a frame keyed region of a grip frame of the grip. The methods also include engaging the frame cover with the grip frame by translating the frame cover and the grip frame relative to one another along an engagement axis. The translating is such that the cover keyed region and the frame keyed region engage with one another and resist relative motion between the frame cover and the grip frame in any direction that is not parallel to the engagement axis. The translating includes translating until the cover keyed region and the frame keyed region contact one another to define a stop that defines a predetermined engaged orientation between the frame cover and the grip frame. The methods further include positioning a single fastener within both a frame fastener receptacle of the grip frame and a cover fastener receptacle of the frame cover to operatively attach the frame cover to the grip frame and resist relative motion between the frame cover and the grip frame along the engagement axis.

DETAILED DESCRIPTION AND BEST MODE OF THE DISCLOSURE

Figure 1:
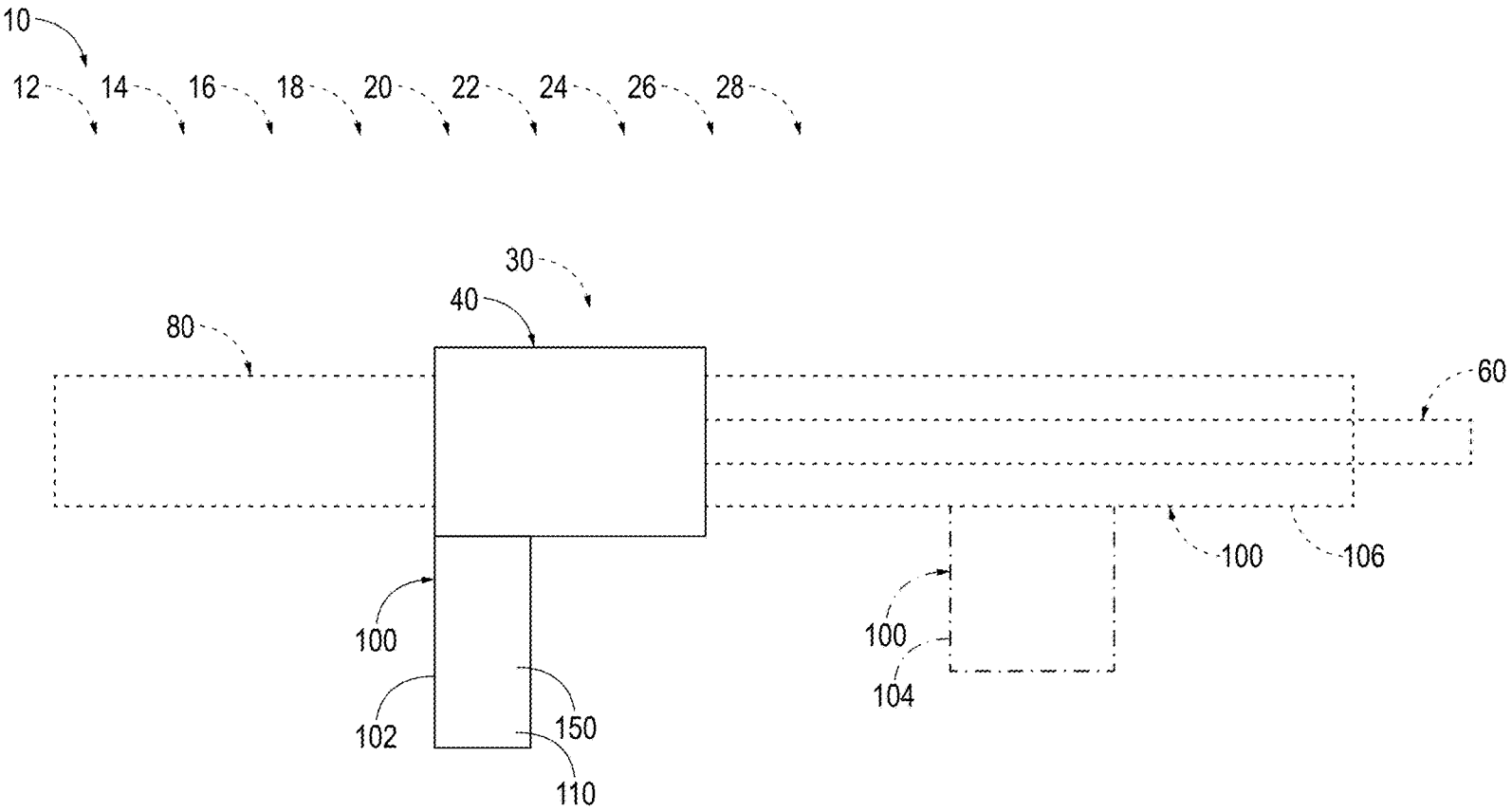
FIG. 1 is a schematic illustration of examples of a handheld projectile weapon that includes and/or may be utilized with grips, according to the present disclosure.

FIGS. 1-36 provide examples of grips 100 and/or of handheld projectile weapons 10 that includes grips 100, according to the present disclosure. Elements that serve a similar, or at least substantially similar, purpose are labeled with like numbers in each of FIGS. 1-36, and these elements may not be discussed in detail herein with reference to each of FIGS. 1-36. Similarly, all elements may not be labeled in each of FIGS. 1-36, but reference numerals associated therewith may be utilized herein for consistency. Elements, components, and/or features that are discussed herein with reference to one or more of FIGS. 1-36 may be included in and/or utilized with any of FIGS. 1-36 without departing from the scope of the present disclosure.

In general, elements that are likely to be included in a particular embodiment are illustrated in solid lines, while elements that are optional are illustrated in dashed lines. However, elements that are shown in solid lines may not be essential to all embodiments and, in some embodiments, may be omitted without departing from the scope of the present disclosure.

FIG. 1 is a schematic illustration of examples of a handheld projectile weapon 10 that includes and/or may be utilized with grips 100, according to the present disclosure. As illustrated in FIG. 1, handheld projectile weapon 10 includes an action 40 and grip 100. Examples of action 40 include any suitable structure that may, or that may be utilized to, load, fire, extract, and/or eject a projectile that is fired by the handheld projectile weapon. More specific examples of action 40 include a loading mechanism, a trigger, a firing pin, an extractor, and/or an ejector. Examples of grip 100 are discussed in more detail herein and include a pistol grip 102, as illustrated in solid lines in FIG. 1, a fore grip 104, as illustrated in dash-dot lines in FIG. 1, and/or a forend, or handguard, 106, as illustrated in dashed lines in FIG. 1. As illustrated in dashed lines in FIG. 1, handheld projectile weapon 10 also may include a barrel 60 and/or a stock 80. As also illustrated in dashed lines in FIG. 1, action 40 may be at least partially and/or completely contained within and/or supported by a receiver 30 of the handheld projectile weapon. Receiver 30 also may be referred to herein as and/or may be a frame 30.

Handheld projectile weapon 10 may include and/or be any suitable structure that includes action 40 and grip 100 and/or that fires a projectile. Examples of handheld projectile weapon 10 include a firearm 12, a rifle 14, a modern sporting rifle 16, a shotgun 18, a handgun 20, a speargun 22, a paintball gun 24, a crossbow 26, and/or an airsoft gun 28.

Figure 2:
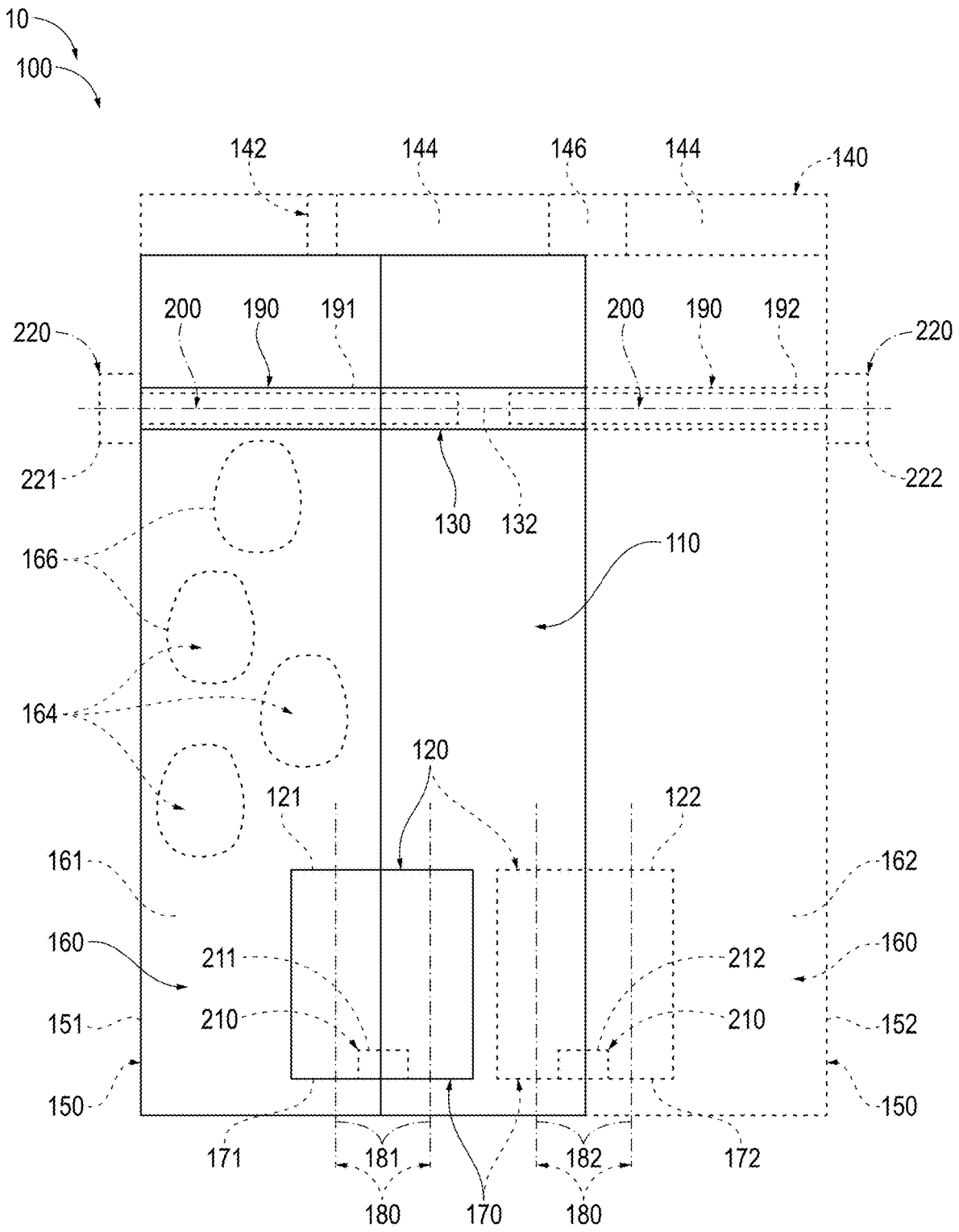
FIG. 2 is a schematic illustration of examples of grips according to the present disclosure.
Figure 4:
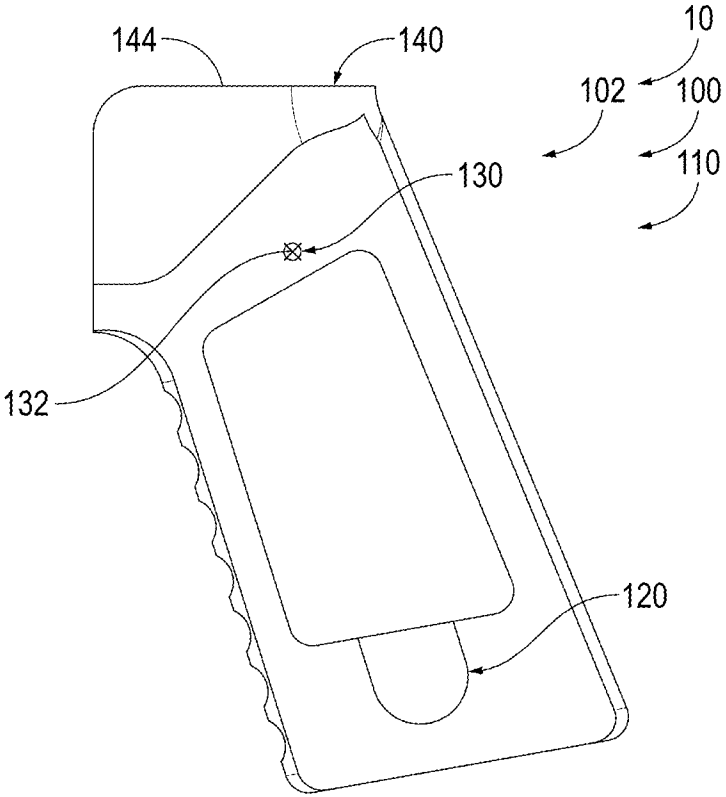
FIG. 4 is a left-side view of the grip frame of FIG. 3.
Figure 3:
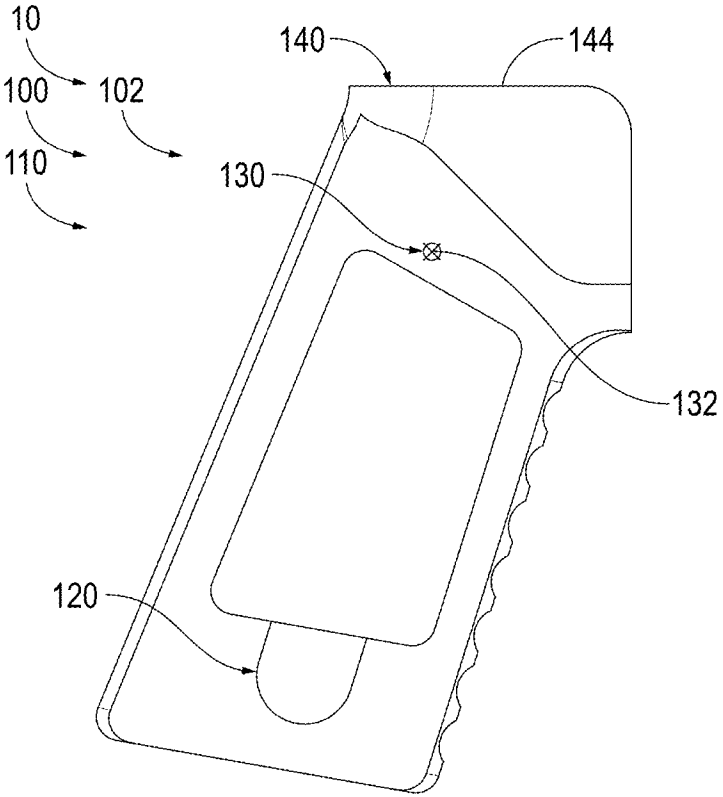
FIG. 3 is a less schematic, right-side view illustrating an example of a grip frame for a grip, according to the present disclosure.
Figure 6:
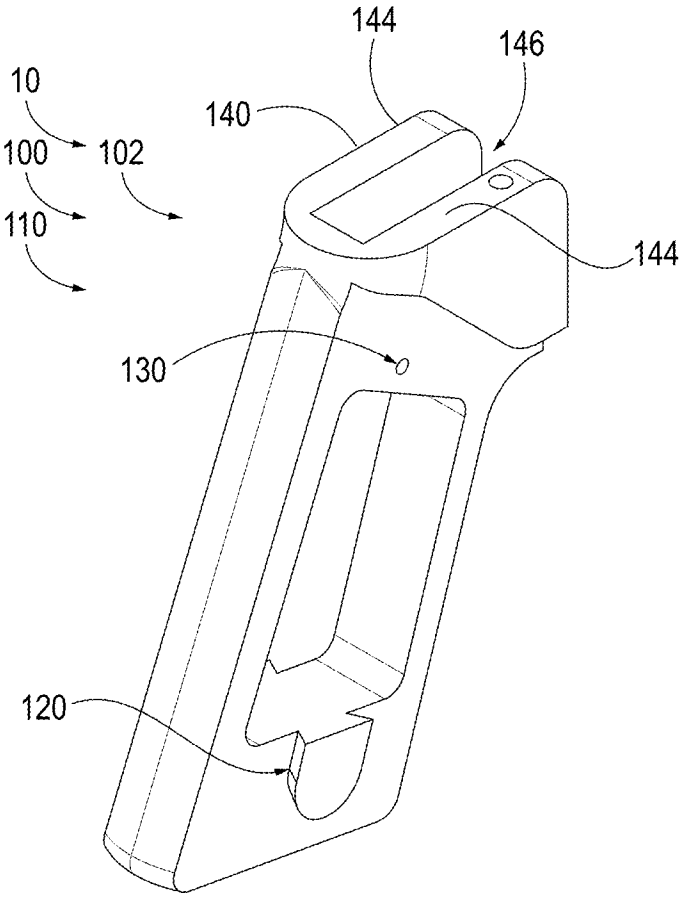
FIG. 6 is a profile view of the grip frame of FIGS. 3-5.
Figure 5:
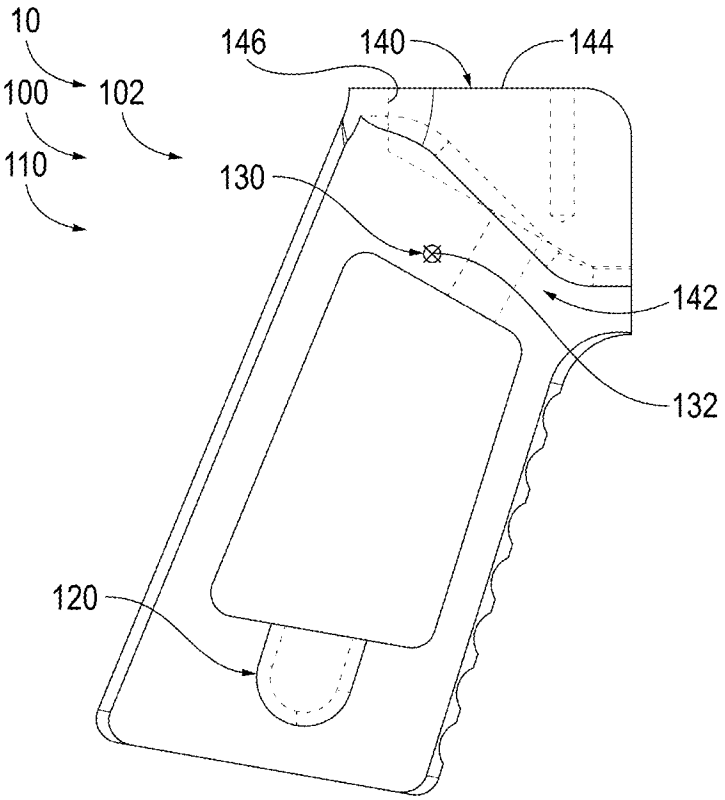
FIG. 5 is the right-side view of the grip frame of FIGS. 3-4, illustrating hidden structures in dashed lines.
Figure 8:
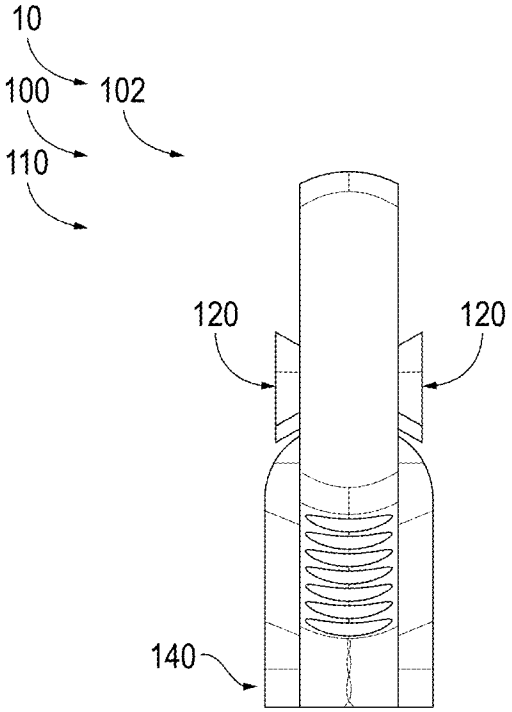
FIG. 8 is a bottom view of the grip frame of FIGS. 3-7.

FIG. 2 is a schematic, illustrative example of grips 100 according to the present disclosure, while FIGS. 3-36 are less schematic illustrations of grips 100. In particular, FIGS. 3-20 illustrate examples of grips 100 and/or components thereof in the form of pistol grips 102; FIGS. 21-27 illustrate an example of grips 100 and/or components thereof in the form of fore grip 104; and FIGS. 28-36 illustrate an example of grips 100 and/or components thereof in the form of fore-end or handguard 106.

As collectively illustrated by FIGS. 2-36 and with specific reference to FIG. 2, grips 100 include a grip frame 110. Grip frame 110 includes a frame keyed region 120 and a frame fastener receptacle 130. In addition, grip frame 110 may include an attachment structure 140, as illustrated in dashed lines in FIG. 2, which may be configured to permit and/or facilitate attachment of the grip frame to, or to a remainder of, the handheld projectile weapon.

As also collectively illustrated by FIGS. 2-36 and with continued specific reference to FIG. 2, grips 100 include a frame cover 150. Frame cover 150 is configured to be operatively attached to grip frame 110, to cover a corresponding region of grip frame 110, and to at least partially define a grip surface 160 of grip 100. Grip surface 160 may be shaped to be held by a user of the handheld projectile weapon, such as during operative use of the handheld projectile weapon to fire the projectile.

Frame cover 150 includes a cover keyed region 170 and a cover fastener receptacle 190. Cover keyed region 170 may be shaped to slidingly engage with frame keyed region 120 along an engagement axis 180. Additionally or alternatively, cover keyed region 170 may be shaped to resist separation of frame cover 150 from grip frame 110 in a single or any direction that is not parallel to the engagement axis. Cover fastener receptacle 190 may be positioned to align with frame fastener receptacle 130, while cover keyed region 170 is slidingly engaged with frame keyed region 120 and/or at a specific relative orientation between grip frame 110 and frame cover 150 along engagement axis 180.

Grip 100 also may include a fastener 220, as illustrated in dashed lines in FIG. 2. Fastener 220 may, or may be configured to, extend through both frame fastener receptacle 130 and cover fastener receptacle 190, such as to resist relative motion between grip frame 110 and frame cover 150. This may include resisting the relative motion along engagement axis 180 and/or resisting the relative motion in a plurality of different, or even all, directions.

Grip frame 110 may include any suitable structure that includes and/or defines frame keyed region 120, frame fastener receptacle 130, and/or attachment structure 140 and/or that may be configured to be operatively attached to the handheld projectile weapon and/or frame cover 150. In addition, grip frame 110 may be formed and/or defined from any suitable frame material, examples of which include a metallic frame material, a composite frame material, and/or a polymeric frame material.

Figure 24:
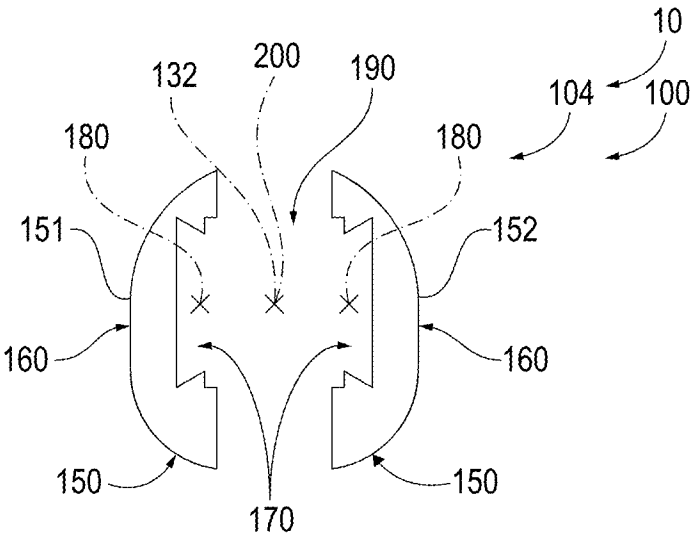
FIG. 24 is a bottom view of the frame covers of FIG. 23.
Figure 23:
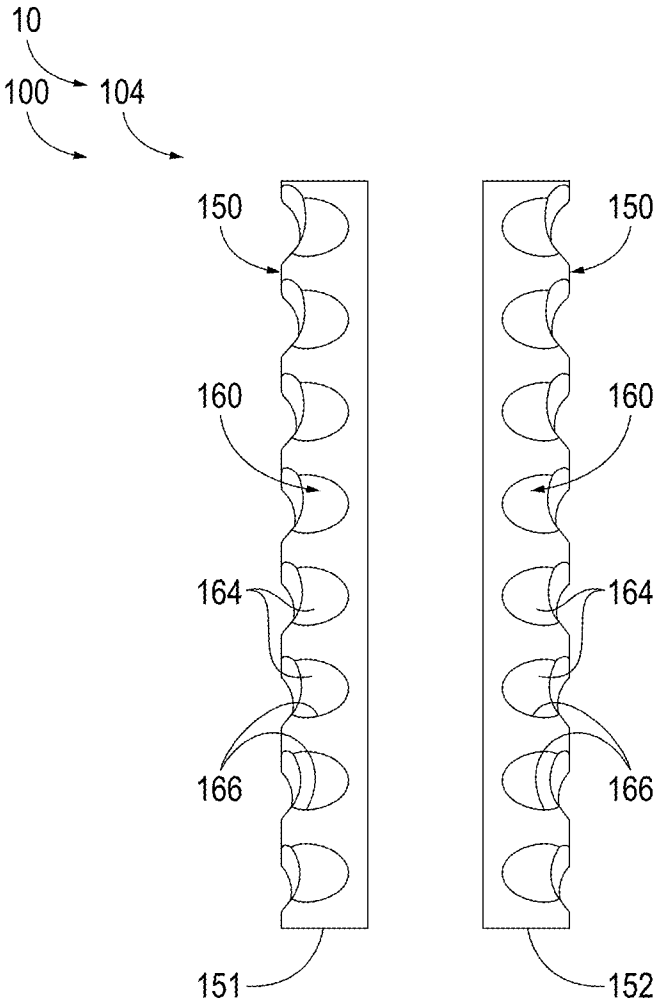
FIG. 23 is a side view illustrating an example of frame covers for the grip frame of FIGS. 21-22.
Figure 26:
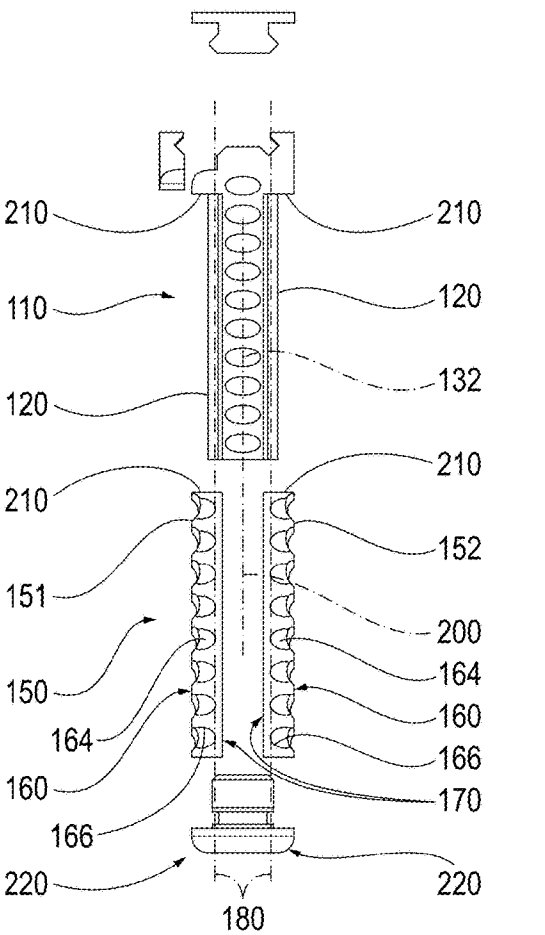
FIG. 26 is an exploded, end view of the grip of FIG. 25.

Frame fastener receptacle 130 may include and/or be any structure that may be adapted, configured, designed, and/or constructed to receive fastener 220. In some examples, frame fastener receptacle 130 may include and/or be a cylindrical, or at least substantially cylindrical, frame fastener receptacle, hole, and/or recess. Frame fastener receptacle 130 may define a bore axis 132. In some examples, bore axis 132 may extend perpendicular, or at least substantially perpendicular, to engagement axis 180. However, this is not required, and it is within the scope of the present disclosure that bore axis 132 alternatively may extend parallel, or at least substantially parallel, to engagement axis 180, as illustrated in FIGS. 24 and 26.

In some examples, frame fastener receptacle 130 may be positioned within a region of grip 100 that is covered by a user's palm and/or fingers when the grip is held by the user. Such a configuration may permit and/or facilitate improved observation and/or tactile detection of an improperly positioned and/or loose fastener 220, thereby decreasing a potential for fastener 220 to fall from the frame fastener receptacle and/or to be lost during operative use of the handheld projectile weapon, such as when in operative use to fire the projectile.

Figure 7:
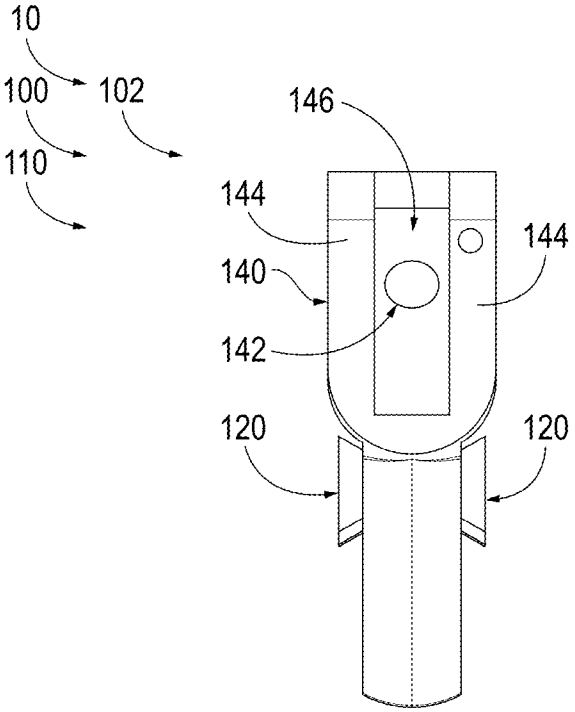
FIG. 7 is a top view of the grip frame of FIGS. 3-6.
Figure 10:
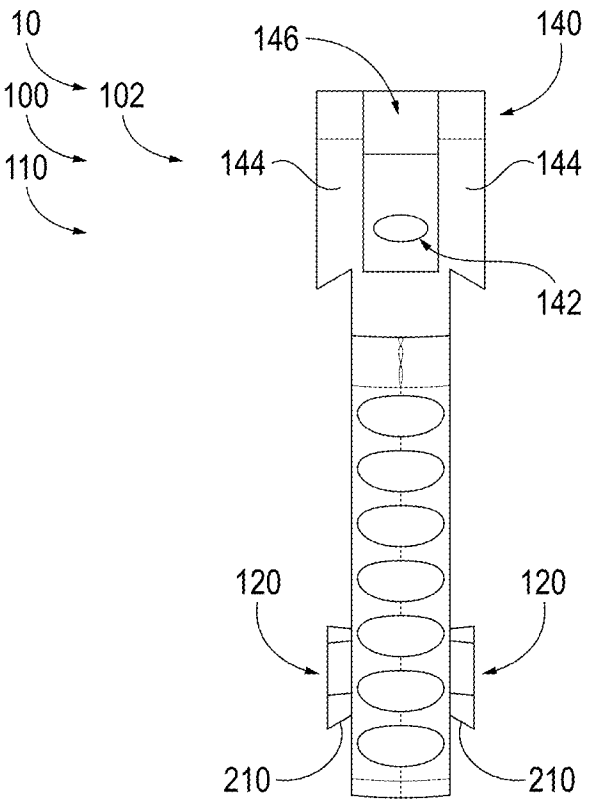
FIG. 10 is a back view of the grip frame of FIGS. 3-9.
Figure 9:
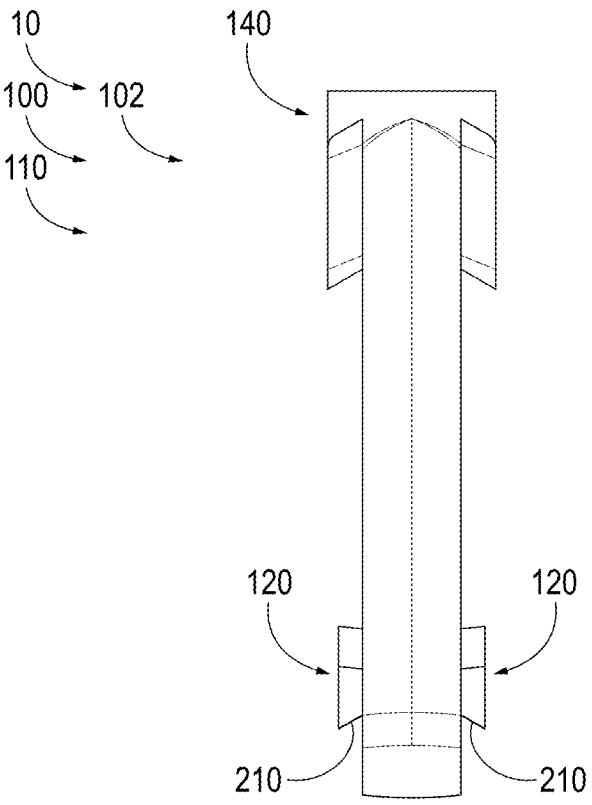
FIG. 9 is a front view of the grip frame of FIGS. 3-8.
Figure 12:
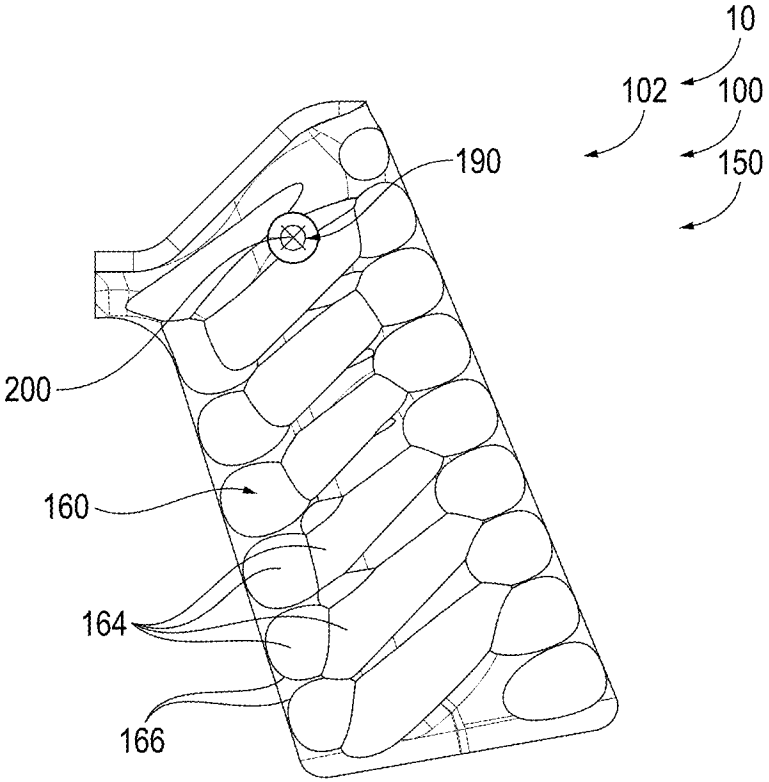
FIG. 12 is an outside view of the frame cover of FIG. 11.
Figure 11:
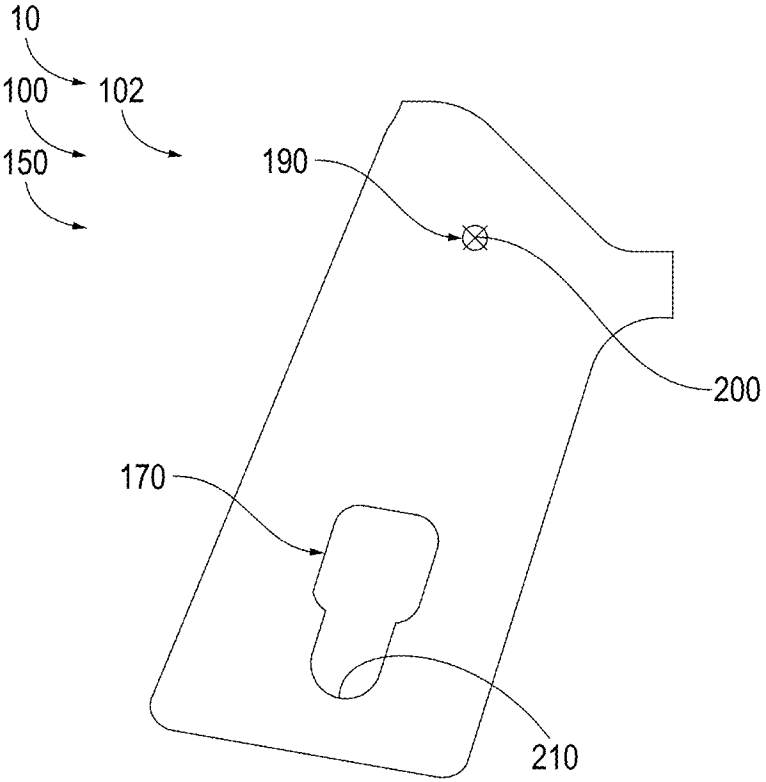
FIG. 11 is a less schematic, inside view illustrating an example of a frame cover for the grip of FIGS. 3-10.

Attachment structure 140 may include any suitable structure that may be adapted, configured, designed, and/or constructed to permit and/or facilitate attachment of grip frame 110 to handheld projectile weapon 10. In some examples, attachment structure 140 may include and/or be an attachment fastener receptacle 142, as illustrated in FIGS. 2, 7, and 10. The attachment fastener receptacle may be configured to receive an attachment fastener that operatively attaches the grip frame to the handheld projectile weapon. In some examples, attachment structure 140 may include an attachment structure projection 144 and/or an attachment structure recess 146. Attachment structure projection 144, when present, may be configured to be received within a corresponding recess and/or slot of the handheld projectile weapon. Attachment structure recess 146, when present, may be configured to receive a corresponding projection of the handheld projectile weapon. Such a configuration may, or may be utilized to, define a specific, a predetermined, and/or a predefined relative orientation between the grip and the handheld projectile weapon.

Frame cover 150 may include any suitable structure that defines gripping surface 160, that includes cover keyed region 170, and/or that includes cover fastener receptacle 190. In addition, frame cover 150 may be formed and/or defined by any suitable cover material, examples of which include a metallic cover material, a polymeric cover material, a composite cover material, a naturally occurring cover material, and/or a wooden cover material.

Cover fastener receptacle 190 may include and/or be any structure that may be adapted, configured, designed, and/or constructed to receive fastener 220 and/or to align with frame fastener receptacle 130 to permit and/or facilitate receipt of fastener 220 within both the cover fastener receptacle and the frame fastener receptacle. In some examples, cover fastener receptacle 190 may include and/or be a cylindrical, or at least substantially cylindrical, cover fastener receptacle, hole, and/or recess. Cover fastener receptacle 190 may define a bore axis 200. Bore axis 200 may extend perpendicular, or at least substantially perpendicular, to engagement axis 180. However, this is not required, and it is within the scope of the present disclosure that bore axis 200 alternatively may extend parallel, or at least substantially parallel, to engagement axis 180, as illustrated in FIGS. 24 and 26.

In some examples, and similar to frame fastener receptacle 130, cover fastener receptacle 190 may be positioned within a region of grip 100 that is covered by the user's palm and/or fingers when the grip is held by the user. Such a configuration, once again, may permit and/or facilitate improved observation and/or tactile detection of an improperly positioned and/or loose fastener 220, thereby decreasing a potential for fastener 220 to fall from the cover fastener receptacle and/or to be lost during operative use of the handheld projectile weapon, when in use to fire the projectile.

Grip surface 160 may include and/or be any suitable surface, texture, recess, and/or projection that may be adapted, configured, shaped, sized, and/or constructed to be held by the user of the handheld projectile weapon. This may include grip surfaces 160 that may provide a comfortable, dependable, reliable, sure, and/or positive grip for the user.

Figure 18:
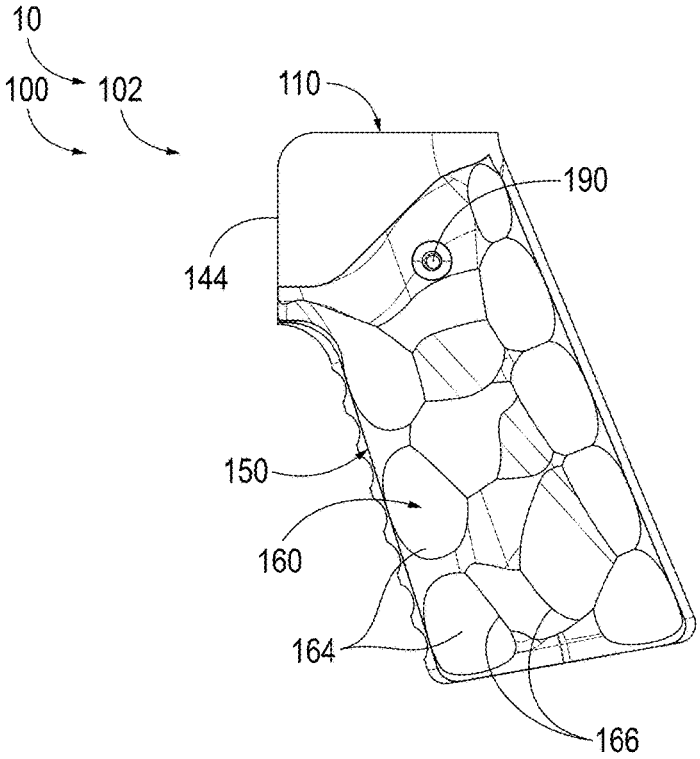
FIG. 18 is a left-side view illustrating an example of another grip according to the present disclosure.
Figure 19:
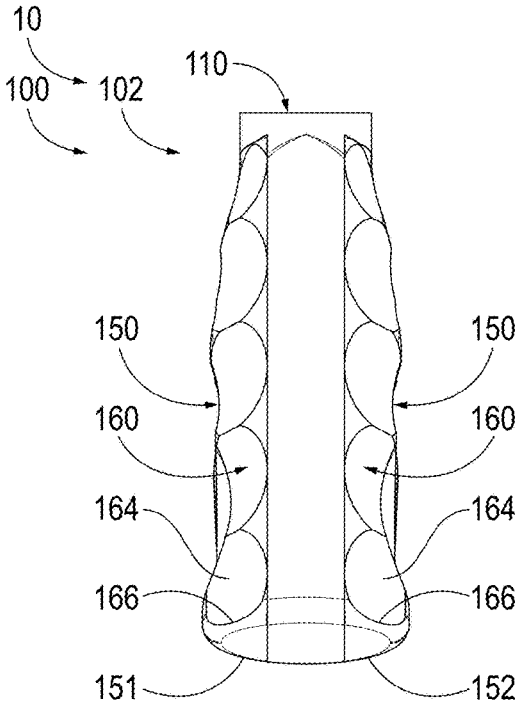
FIG. 19 is a back-side view of the grip of FIG. 18.
Figure 20:
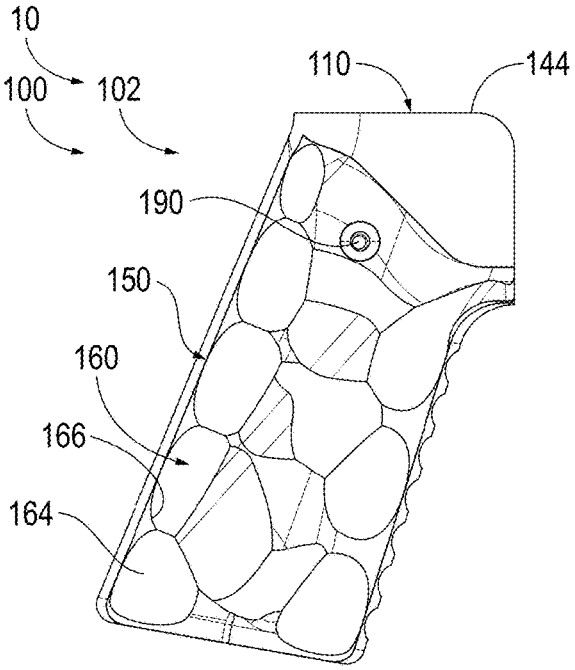
FIG. 20 is a right-side view of the grip of FIGS. 18-19.
Figure 22:
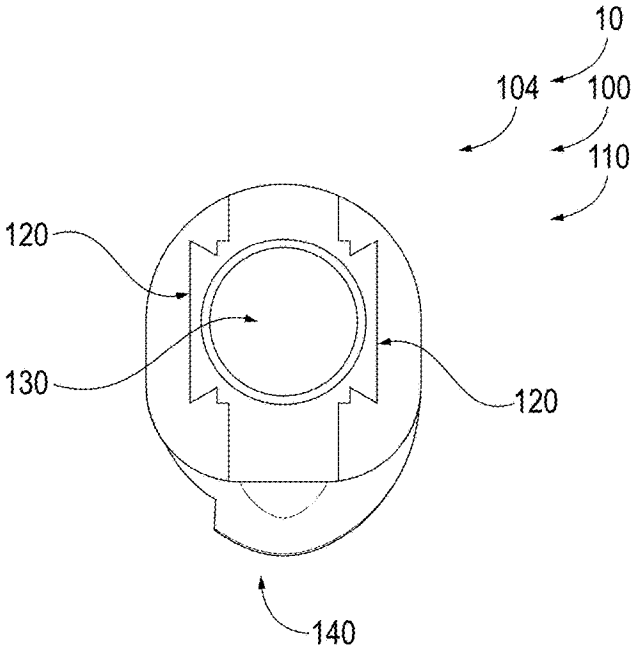
FIG. 22 is a bottom view of the grip frame of FIG. 21.
Figure 21:
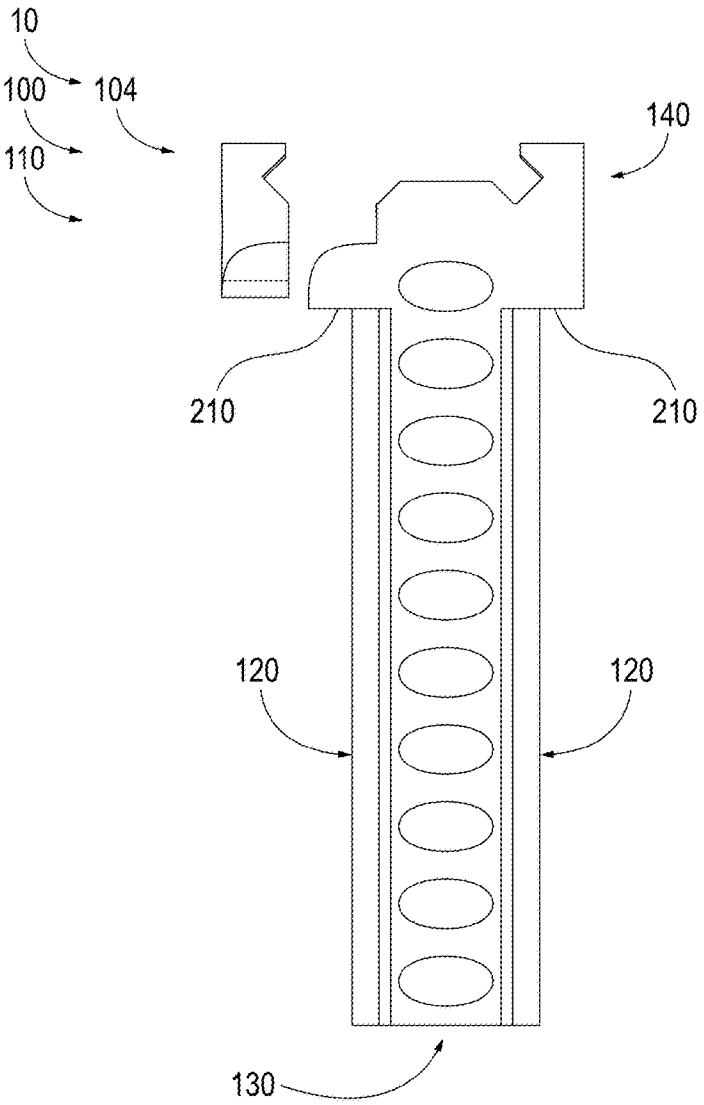
FIG. 21 is a less schematic, back-side view illustrating an example of another grip frame for another grip, according to the present disclosure.

In some examples, and as illustrated schematically in FIG. 2 and less schematically in FIGS. 12-20, 23-27, and 30-31, grip surface 160 may include and/or may define a plurality of concave recesses 164. When present, concave recesses 164 may be shaped at least partially like snake scales, as illustrated in FIGS. 12-17, and/or at least partially like fish scales, as illustrated in FIGS. 18-20. In some examples, concave recesses 164 may have and/or define an at least partially arcuate outer perimeter 166. It is within the scope of the present disclosure that grip surface 160 of any or all frame covers 150, which are disclosed herein, may include concave recesses 164 that may define arcuate outer perimeter 166.

Careful selection of a location and dimension of concave recesses 164 may provide a grip surface 160 that is comfortable for the user, and that provides a sure grip on the handheld projectile weapon. Examples of the location of concave recesses 164 are illustrated in FIGS. 12-20, 23-27, and 30-31. Examples of the dimension of concave recesses 164 include a maximum extent, a diameter, an effective diameter, an average maximum extent, an average diameter, and/or an average effective diameter of at least 10 millimeters (mm), at least 12 mm, at least 14 mm, at least 16 mm, at least 18 mm, at least 20 mm, at least 22 mm, at least 24 mm, at least 26 mm, at least 28 mm, at least 30 mm, at least 32 mm, at least 34 mm, at least 36 mm, at least 38 mm, at least 40 mm, at least 42 mm, at least 44 mm, at least 46 mm, at least 48 mm, at least 50 mm, at most 60 mm, at most 55 mm, at most 50 mm, at most 45 mm, at most 40 mm, at most 35 mm, at most 30 mm, at most 25 mm, at most 20 mm, and/or at most 15 mm.

As illustrated at least in FIGS. 2, 13-15, 19, 23-24, and 26, and in some examples, grips 100 may include a plurality of frame covers 150, including at least a first frame cover 151 and a second frame cover 152. In such a configuration and with specific reference to FIG. 2, first frame cover 151 may define a first region 161 of grip surface 160, may include a first cover-keyed region 171, and/or may include a first cover-fastener receptacle 191. Similarly, second frame cover 152 may define a second region 162 of grip surface 160, may include a second cover-keyed region 172, and/or a second cover-fastener receptacle 192.

In addition, grip frame 110 may include a first frame-keyed region 121 and a second frame-keyed region 122. Similarly, first cover-keyed region 171 may be configured to slidingly engage with first frame-keyed region 121 along a first engagement axis 181, and to resist separation of the first frame cover 151 from the grip frame in any direction that is not parallel to first engagement axis. Additionally or alternatively, second cover-keyed region 172 may be configured to slidingly engage with second frame-keyed region 122 along a second engagement axis 182, and to resist separation of the second frame cover 152 from the grip frame in any direction that is not parallel to the second engagement axis. Furthermore, first cover-fastener receptacle 191 may be positioned to align with frame fastener receptacle 130 when first cover-keyed region 171 is slidingly engaged with first frame-keyed region 121, and/or second cover-fastener receptacle 192 may be positioned to align with frame fastener receptacle 130, or with the same frame fastener receptacle 130, when second cover-keyed region 172 is slidingly engaged with second frame-keyed region 122.

In some examples, first engagement axis 181 may be parallel, or at least substantially parallel, to second engagement axis 182. In some examples, first engagement axis 181 may be spaced-apart and/or distinct from second engagement axis 182.

In some examples, first frame-keyed region 121 and second frame-keyed region 122 may be on opposed sides of grip frame 110. In some examples, first frame-keyed region 121 and second frame-keyed region 122 may be directly opposed to one another, may extend away from one another, and/or may extend directly away from one another.

In some examples, first frame cover 151 and second frame cover 152, or first region 161 and second region 162 thereof, may define opposed sides of grip 100, such as when the first frame cover is slidingly engaged with the first frame-keyed region and the second frame cover is slidingly engaged with the second frame-keyed region. In some such examples, first region 161 may face away from second region 162.

Frame keyed region 120 and cover keyed region 170, which collectively may be referred to herein as keyed regions 120/170, may include any suitable structure that may be configured to engage with one another along engagement axis 180 and resist relative motion between grip frame 110 and frame cover 150 in direction that are not parallel to the engagement axis. As an example, one of frame keyed region 120 and cover keyed region 170 may include and/or be a male keyed region, and the other of frame keyed region 120 and cover keyed region 170 may include and/or be a female keyed region, which may be configured to receive the male keyed region along the engagement axis. As another example, one of frame keyed region 120 and cover keyed region 170 may include and/or be a keyed region projection, and the other of frame keyed region 120 and cover keyed region 170 may include and/or be a keyed region recess, which may be configured to receive the keyed region projection along the engagement axis. Stated differently, one of the frame keyed region and the cover keyed region may be shaped to be slidingly received within the other of the frame keyed region and the covered keyed region, such as along the engagement axis.

In a specific example, frame keyed region 120 may include and/or be a dovetail-shaped frame keyed region, and cover keyed region 170 may include and/or be a dovetail-shaped cover keyed region. In some such examples, the dovetail-shaped frame keyed region may include and/or be one of a dovetail-shaped projection and a dovetail-shaped recess, and the dovetail-shaped cover keyed region may include and/or be the other of the dovetail-shaped projection and the dovetail-shaped recess.

Figure 16:
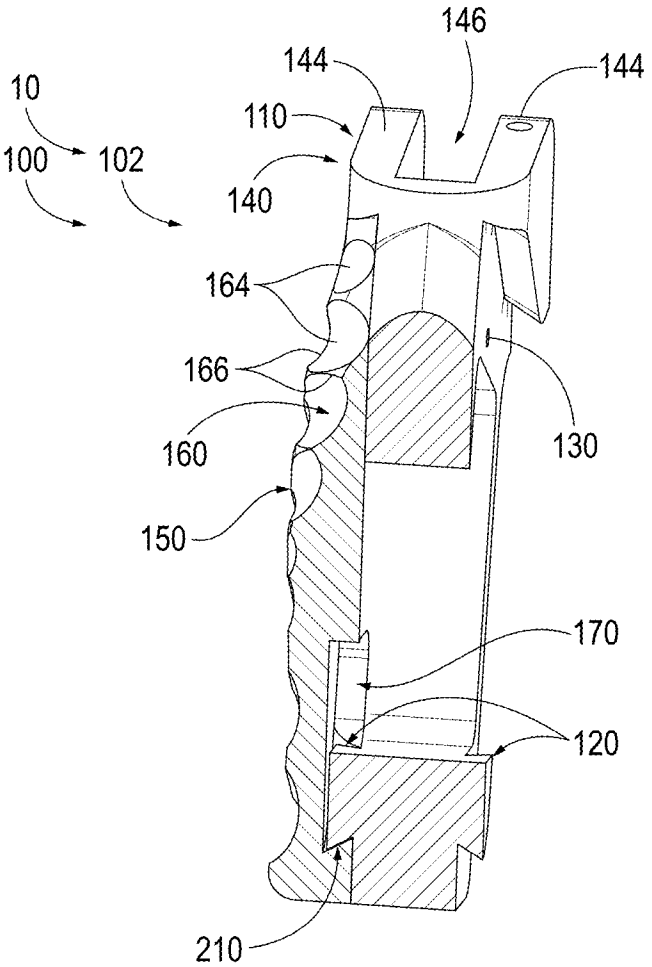
FIG. 16 is a cross-sectional view of a partially assembled grip of FIGS. 13-15.

In some examples, frame keyed region 120 and cover keyed region 170 together define a stop 210, as perhaps best illustrated in FIGS. 2, 16, and 26. When present, stops 210 may be configured to define an engaged orientation, a specific engaged orientation, and/or a predetermined engaged orientation between grip frame 110 and frame cover 150 along engagement axis 180. As an example and when in the engaged orientation, bore axis 132 of frame fastener receptacle 130 may be aligned with bore axis 200 of cover fastener receptacle 190. When grip 100 includes first frame cover 151 and second frame cover 152, grip 100 may include a plurality of stops 210, including a first stop 211 and a second stop 212, with each stop 210 associated with grip frame 110 and a given frame cover 150.

Fastener 220 may include any suitable structure that may be configured to be received and/or retained within frame fastener receptacle 130 and cover fastener receptacle 190. An example of fastener 220 includes a screw. In such an example, frame fastener receptacle 130 may define a frame-threaded region into which the screw may be threaded. When grip 100 includes first frame cover 151 and second frame cover 152, grip 100 may include a plurality of screws 220, including a first screw 221 and a second screw 222, with each screw 220 being associated with grip frame 110 and a given frame cover 150.

Grips 100, which are disclosed herein, may provide a number of benefits over conventional grips for handheld projectile weapons. As an example, a shape and/or a texture of grip surface 160 may provide an improved grip for the user when compared to the conventional grips. As another example, grips 100 may be configured to be reconfigured and/or refurbished, such as via replacement of frame cover 150. This may include replacement of a damaged frame cover 150, replacement of frame cover 150 for aesthetic purposes, and/or replacement of frame cover 150 for functional purpose, such as to provide a differently shaped and/or textured grip surface 160. As discussed, grips 100 according to the present disclosure may be configured such that the user readily may detect, such as via tactile contact, a loose frame cover 150 and/or a loose fastener 220, thereby decreasing a potential for loss of frame cover 150.

In addition, frame covers 150 of grips 100 may be simply and readily replaced in a manner that decreases a potential for loss of one or more components of grips 100. As an example, a method of assembling grips 100 may include aligning cover keyed region 170 of frame cover 150 with frame keyed region 120 of grip frame 110. This is illustrated in FIG. 13 for pistol grip 102 style grip 100, in FIGS. 25-26 for fore grip 104 style grip 100, and in FIG. 34 for forend or handguard 106 style grip 100.

The method of assembling then may include engaging the frame cover with the grip frame by translating the frame cover and the grip frame relative to one another, such as via translation of the frame cover relative to the grip frame and/or via translation of the grip frame relative to the frame cover. The translating may include translating along an engagement axis 180, as illustrated in FIGS. 2, 14, 26, and 34, such that the cover keyed region and the frame keyed region engage with one another. Once engaged with one another and as discussed, the cover keyed region and the frame keyed region may resist relative motion between the frame cover and the grip frame in any direction that is not parallel, or at least substantially parallel, to engagement axis 180.

Subsequently, the method of assembling may include positioning a fastener 220, or a single fastener 220, within both a frame fastener receptacle 130 of grip frame 110 and a cover fastener receptacle 190 of frame cover 150. This may include positioning to operatively attach the frame cover to the grip frame, and/or to resist relative motion between the frame cover and the grip frame along the engagement axis, or even in all directions, and is illustrated in FIGS. 2, 15, 27, and 36.

Figure 13:
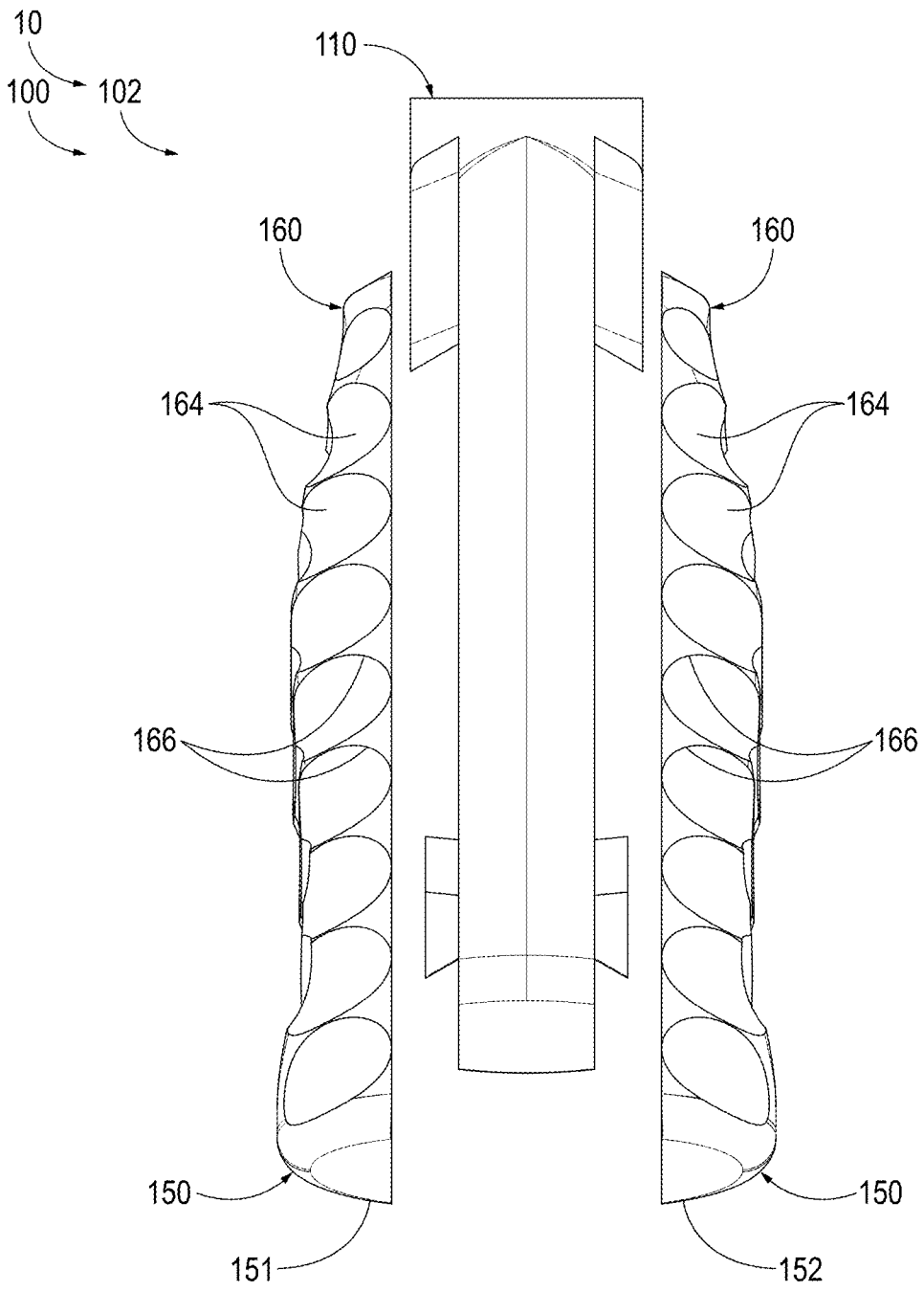
FIG. 13 illustrates a step during the assembly of a grip that includes the grip frame of FIGS. 3-10 and the frame cover of FIGS. 11-12.
Figure 15:
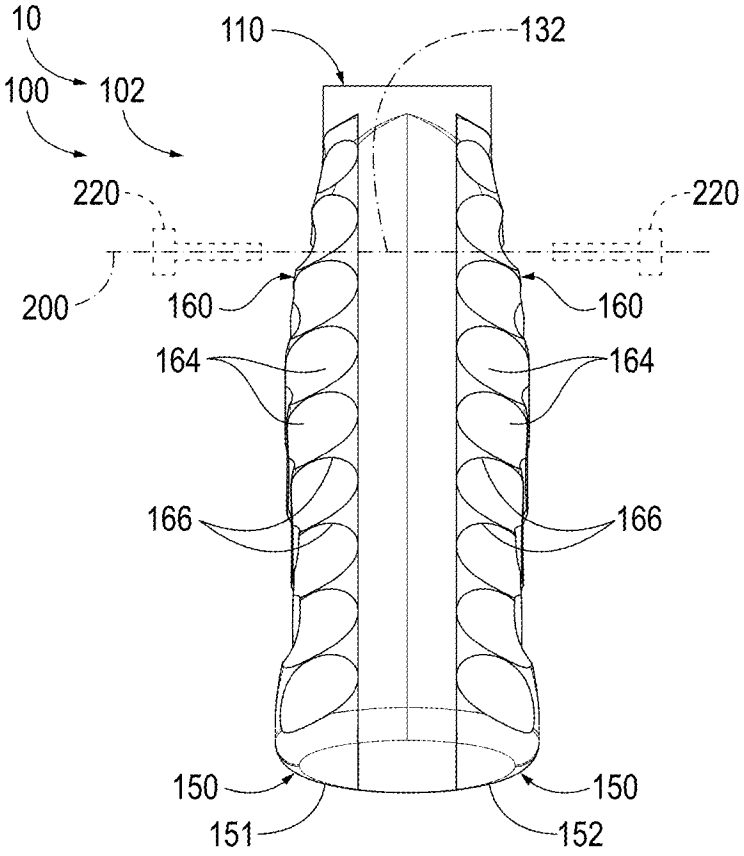
FIG. 15 illustrates another step during the assembly of the grip of FIGS. 13-14.
Figure 14:
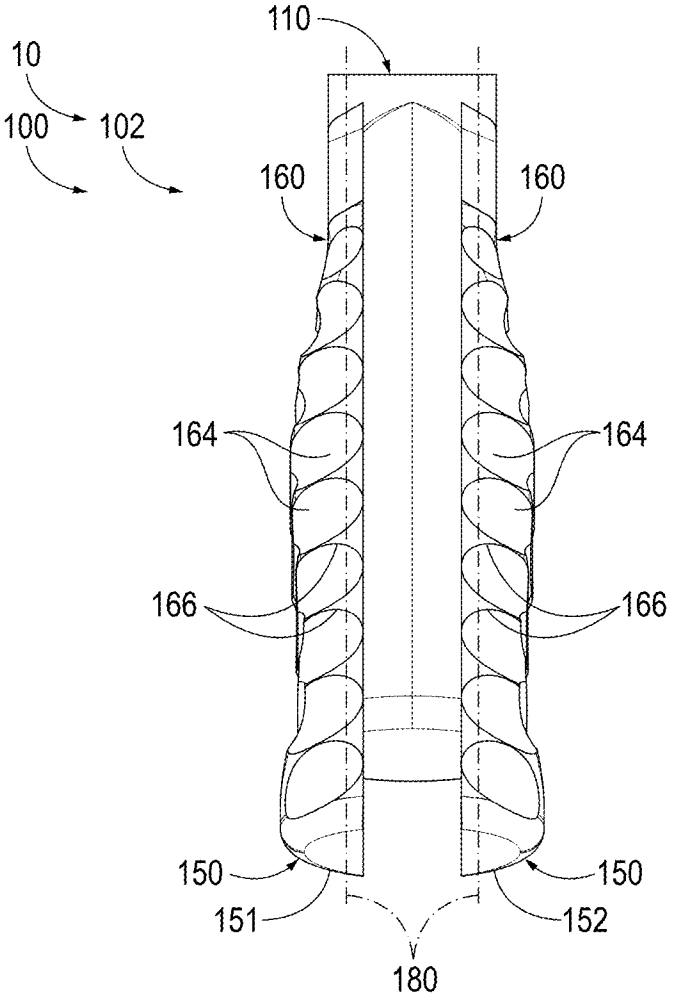
FIG. 14 illustrates another step during the assembly of the grip of FIG. 13.
Figure 17:
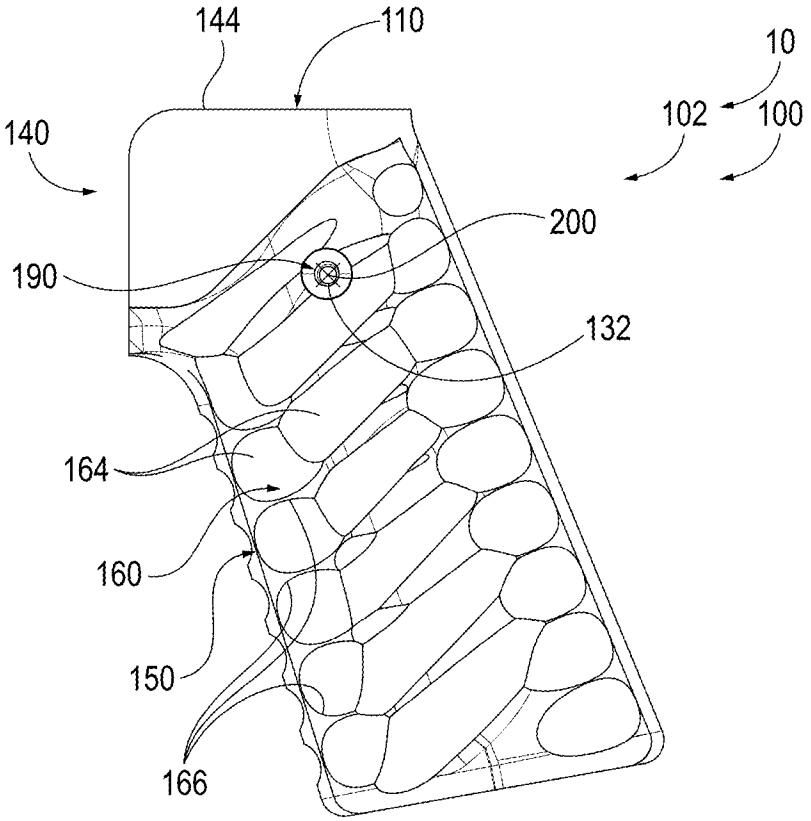
FIG. 17 is a side view of the assembled grip of FIGS. 13-15.

In a first specific example, such as when the grip includes pistol grip 102, the method of assembling may include translating frame cover 150 and grip frame 110 toward one another such that frame keyed region 120 is received within cover keyed region 170, as illustrated by the transition from the configuration illustrated in FIG. 13 to the configuration illustrated in FIG. 14. This may include translating in a direction that is perpendicular, or at least substantially perpendicular, to engagement axis 180. Subsequently, the method of assembling may include translation of the frame cover and the grip frame relative to one another along the engagement axis, as illustrated by the transition from the configuration illustrated in FIG. 14 to the configuration illustrated in FIG. 15. This may include translating until the frame keyed region and the cover keyed region contact one another to define stop 210, as illustrated in FIG. 16. Subsequently and as illustrated in FIG. 15, a fastener 220 may be translated along bore axis 132, such that the fastener extends within the cover fastener receptacle and also within the frame fastener receptacle, thereby retaining the frame cover on the frame. In this example, and as illustrated, bore axis 132 may extend perpendicular, or at least substantially perpendicular, to engagement axis 180.

Figure 25:
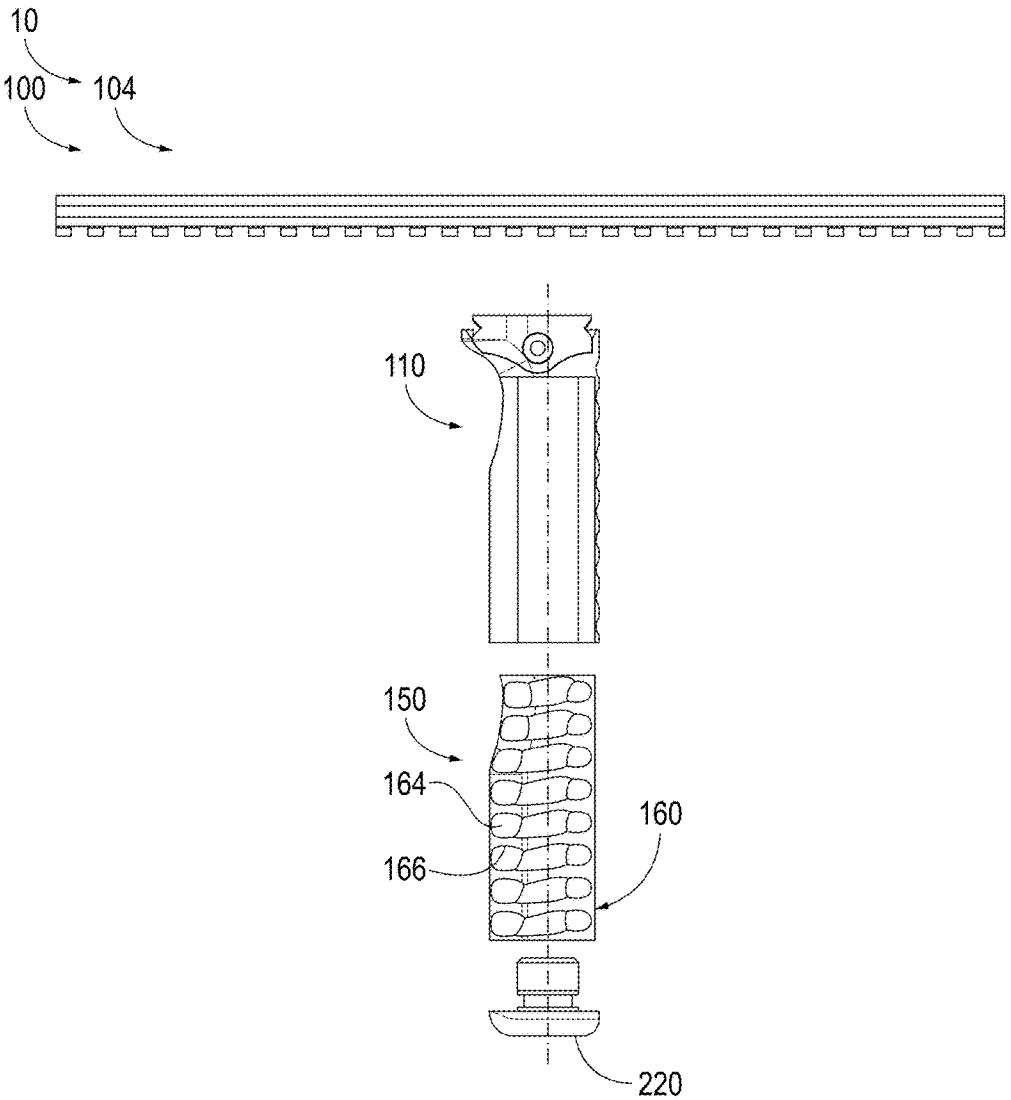
FIG. 25 is an exploded, side view illustrating an example of a grip that includes the grip frame of FIGS. 21-22 and the frame covers of FIGS. 23-24.
Figure 27:
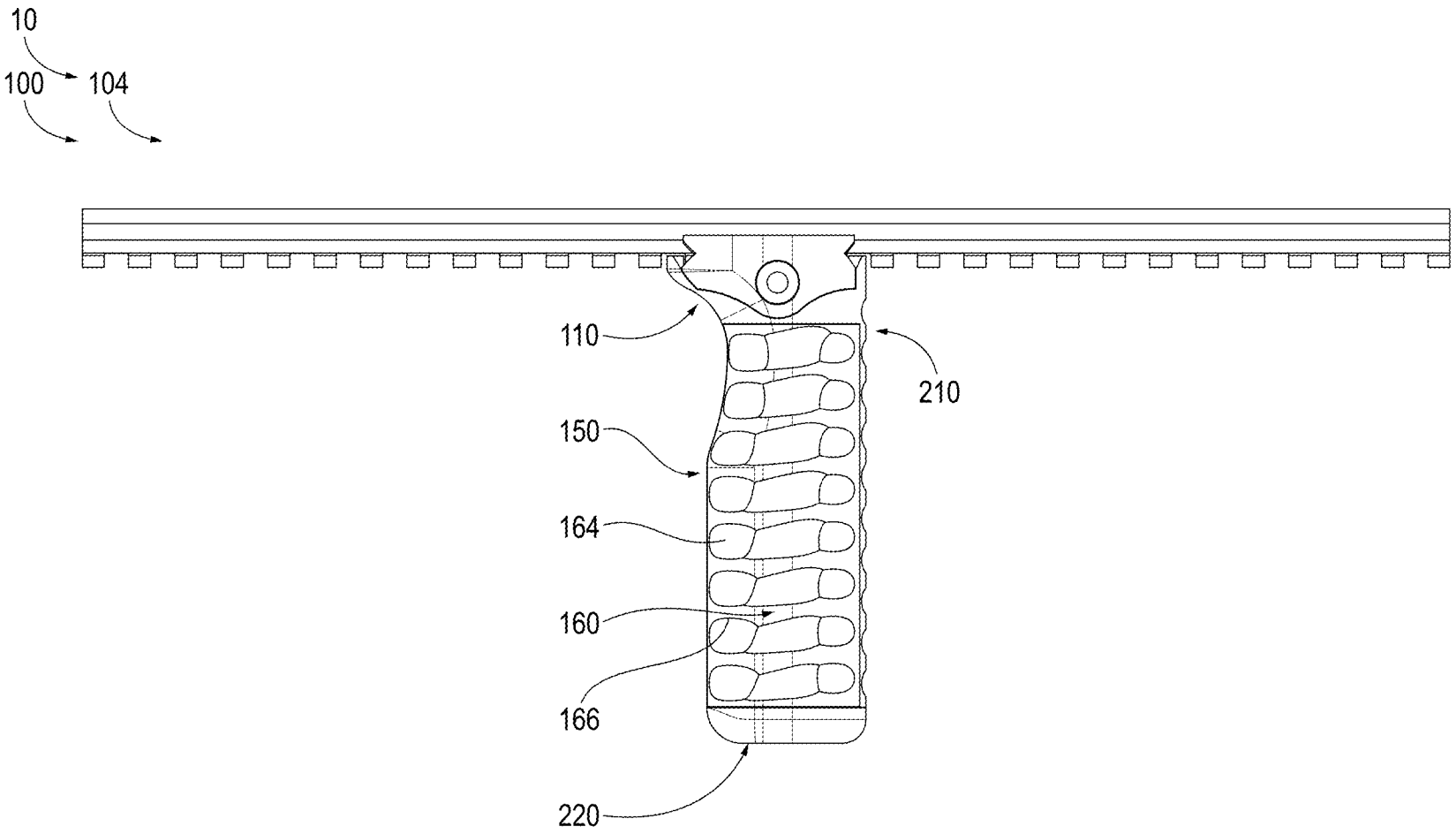
FIG. 27 is an assembled view of the grip of FIGS. 25-26.
Figure 28:
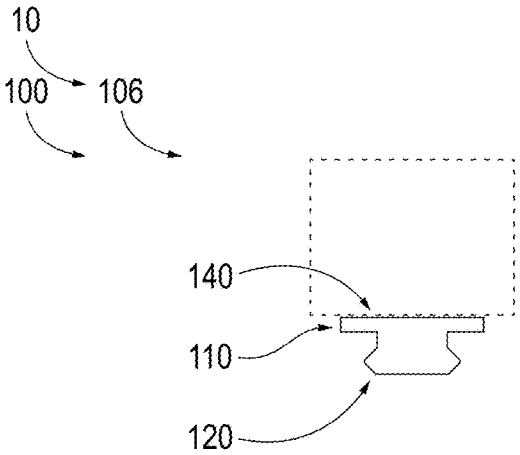
FIG. 28 is an end view illustrating an example of another grip frame for another grip, according to the present disclosure.
Figure 29:
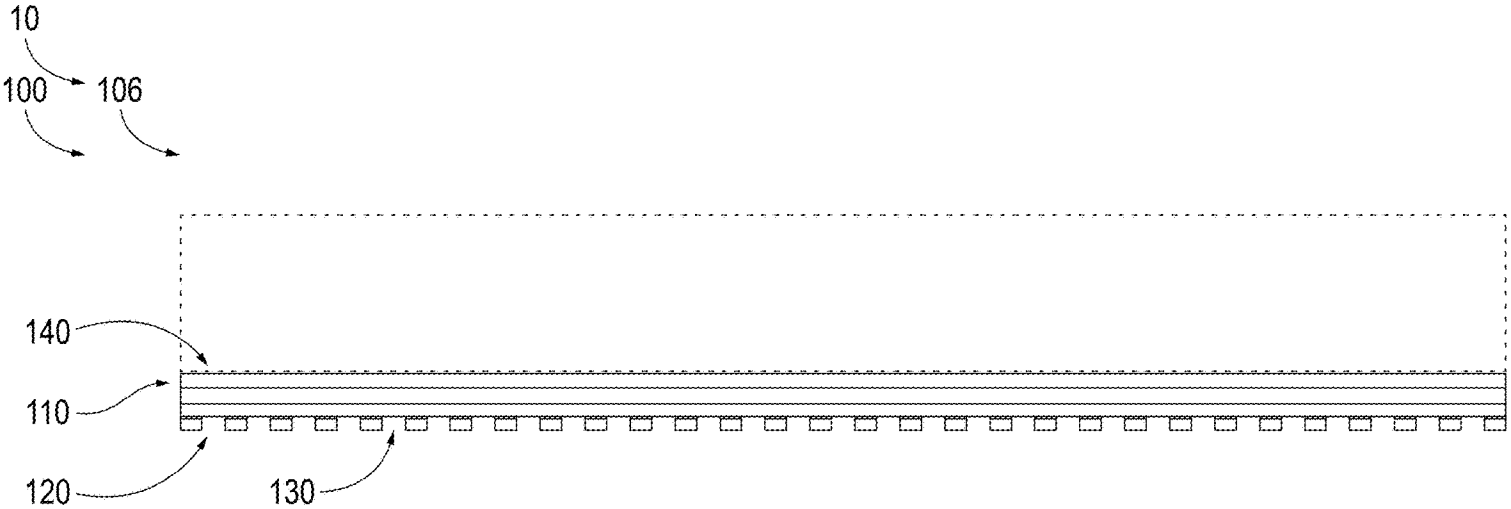
FIG. 29 is a side view of the grip frame of FIG. 28.
Figure 30:
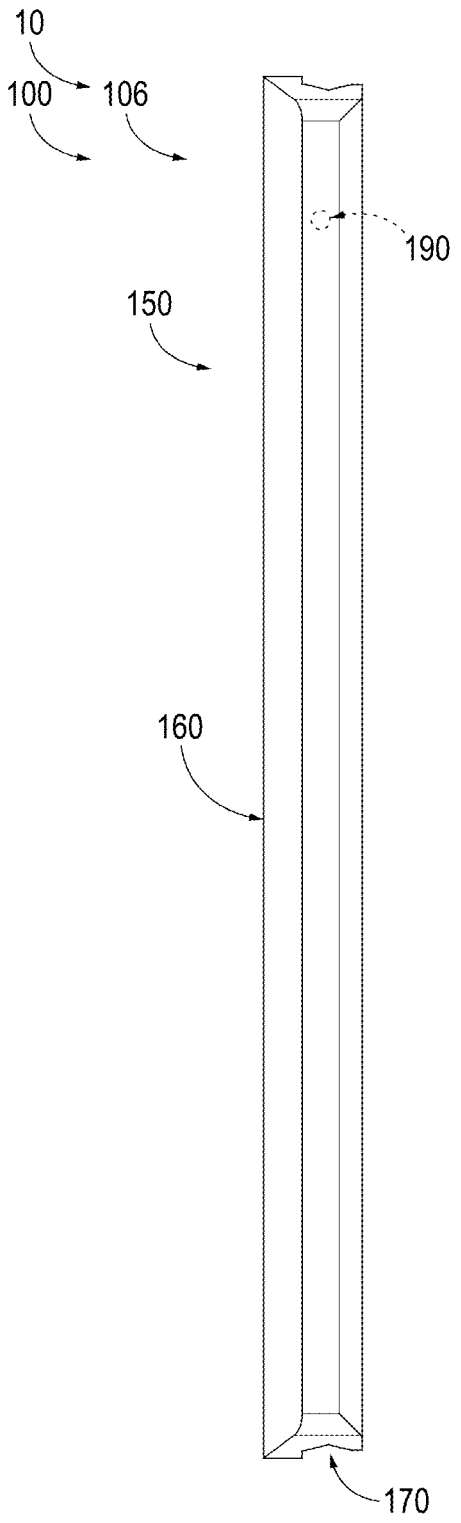
FIG. 30 is a side view illustrating an example of a frame cover for the grip frame of FIGS. 28-29.
Figure 31:
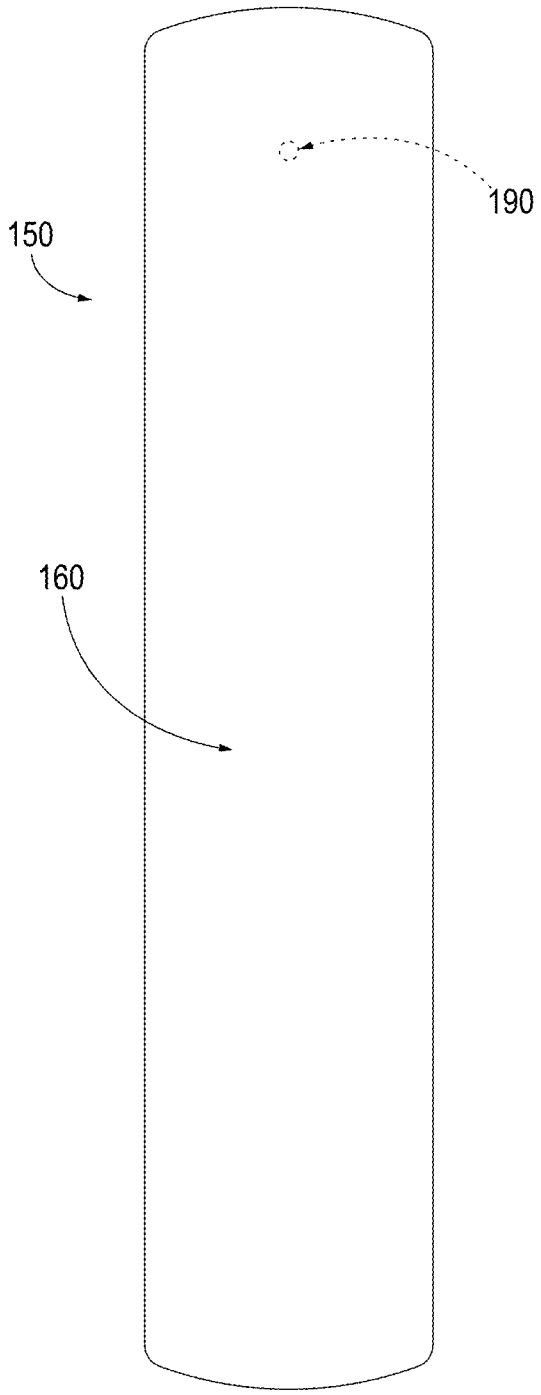
FIG. 31 is a bottom view of the frame cover of FIG. 30.
Figure 32:
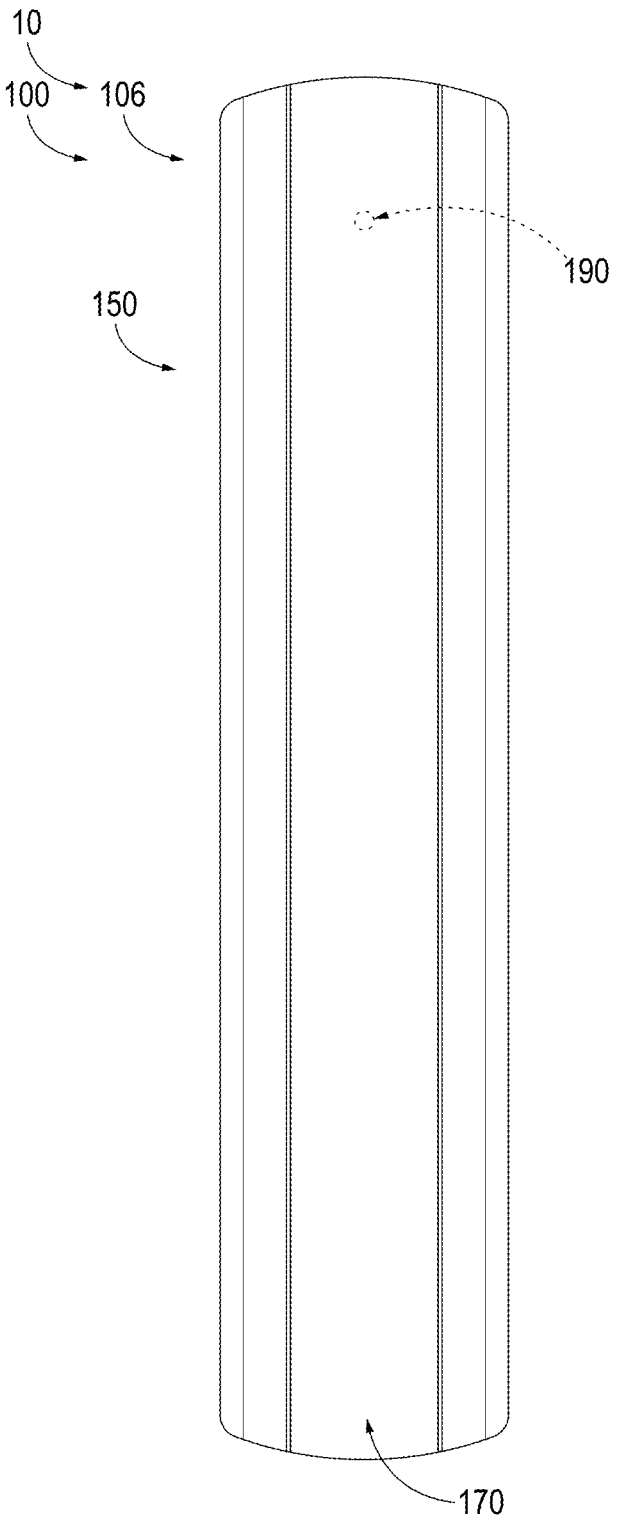
FIG. 32 is a top view of the frame cover of FIGS. 30-31.
Figure 33:
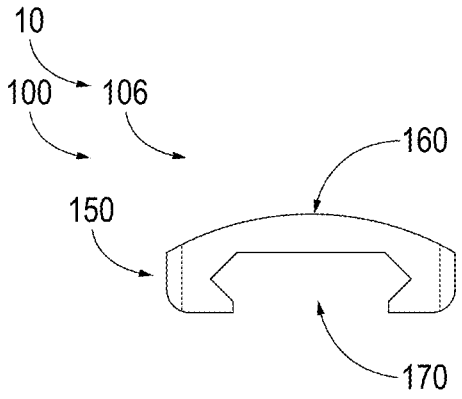
FIG. 33 is an end view of the frame cover of FIGS. 30-32.
Figure 34:
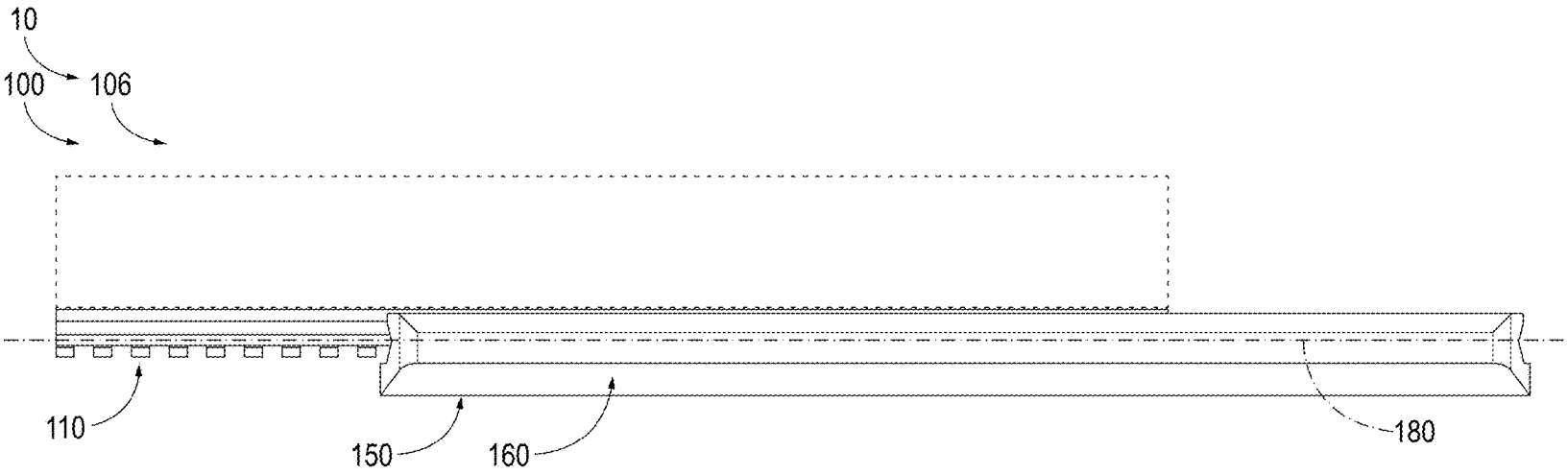
FIG. 34 illustrates a step during assembly of a grip that includes the grip frame of FIGS. 28-29 and the frame cover of FIGS. 30-33.
Figure 35:
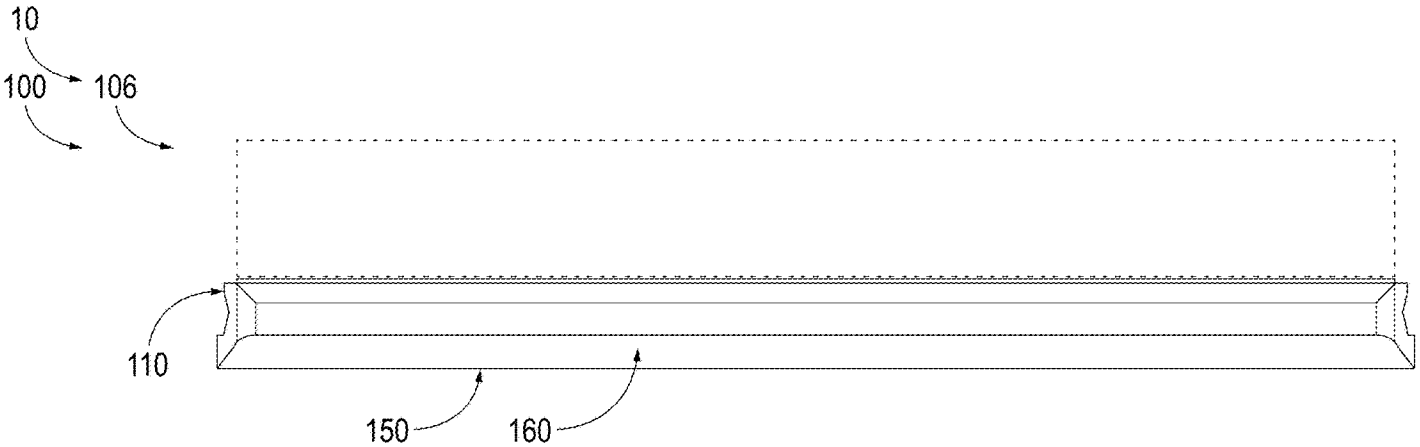
FIG. 35 is a side view illustrating the grip that includes the grip frame of FIGS. 28-29 and the frame cover of FIGS. 30-33.
Figure 36:
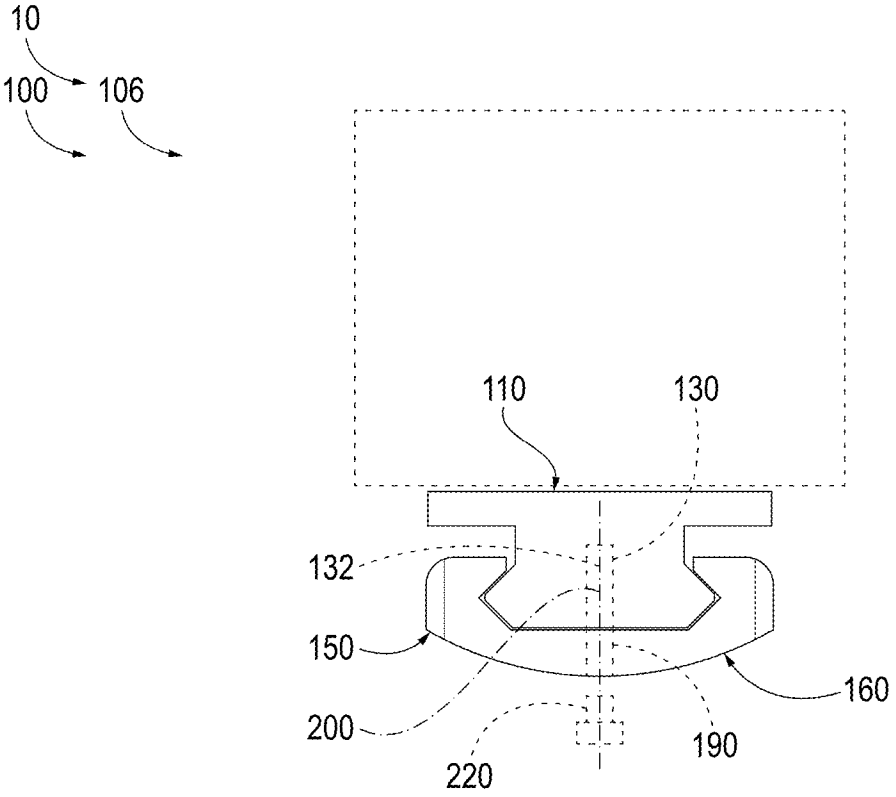
FIG. 36 is an end view of the grip of FIG. 35.

In a second specific example, such as when the grip includes fore grip 104, the method of assembling may include positioning frame cover 150 along engagement axis 180 such that frame keyed region 120 is aligned with cover keyed region 170, as illustrated in FIGS. 25-26. Subsequently, the method of assembling may include translating the frame cover and the grip frame relative to one another along engagement axis 180, as illustrated by the transition from the configuration illustrated in FIGS. 25-26 to the configuration illustrated in FIG. 27. This may include translating until the frame keyed region and the cover keyed region contact one another to define stop 210, as illustrated in FIG. 27. Subsequently and as illustrated by the transition from the configuration illustrated in FIGS. 25-26 to the configuration illustrated in FIG. 27, a fastener 220 may be translated along bore axis 132, such that the fastener extend within the frame fastener receptacle and/or within the cover fastener receptacle, thereby retaining the frame cover on the frame. In this example and as illustrated, bore axis 132 may extend parallel, or at least substantially parallel, to engagement axis 180.

As used herein, the term "and/or" placed between a first entity and a second entity means one of (1) the first entity, (2) the second entity, and (3) the first entity and the second entity. Multiple entities listed with "and/or" should be construed in the same manner, i.e., "one or more" of the entities so conjoined. Other entities may optionally be present other than the entities specifically identified by the "and/or" clause, whether related or unrelated to those entities specifically identified. Thus, as a non-limiting example, a reference to "A and/or B," when used in conjunction with open-ended language such as "comprising" may refer, in one embodiment, to A only (optionally including entities other than B); in another embodiment, to B only (optionally including entities other than A); in yet another embodiment, to both A and B (optionally including other entities). These entities may refer to elements, actions, structures, steps, operations, values, and the like.

As used herein, the phrase "at least one," in reference to a list of one or more entities should be understood to mean at least one entity selected from any one or more of the entities in the list of entities, but not necessarily including at least one of each and every entity specifically listed within the list of entities and not excluding any combinations of entities in the list of entities. This definition also allows that entities may optionally be present other than the entities specifically identified within the list of entities to which the phrase "at least one" refers, whether related or unrelated to those entities specifically identified. Thus, as a non-limiting example, "at least one of A and B" (or, equivalently, "at least one of A or B," or, equivalently "at least one of A and/or B") may refer, in one embodiment, to at least one, optionally including more than one, A, with no B present (and optionally including entities other than B); in another embodiment, to at least one, optionally including more than one, B, with no A present (and optionally including entities other than A); in yet another embodiment, to at least one, optionally including more than one, A, and at least one, optionally including more than one, B (and optionally including other entities). In other words, the phrases "at least one," "one or more," and "and/or" are open-ended expressions that are both conjunctive and disjunctive in operation. For example, each of the expressions "at least one of A, B, and C," "at least one of A, B, or C," "one or more of A, B, and C," "one or more of A, B, or C," and "A, B, and/or C" may mean A alone, B alone, C alone, A and B together, A and C together, B and C together, A, B, and C together, and optionally any of the above in combination with at least one other entity.

In the event that any patents, patent applications, or other references are incorporated by reference herein and (1) define a term in a manner that is inconsistent with and/or (2) are otherwise inconsistent with, either the non-incorporated portion of the present disclosure or any of the other incorporated references, the non-incorporated portion of the present disclosure shall control, and the term or incorporated disclosure therein shall only control with respect to the reference in which the term is defined and/or the incorporated disclosure was present originally.

As used herein the terms "adapted" and "configured" mean that the element, component, or other subject matter is designed and/or intended to perform a given function. Thus, the use of the terms "adapted" and "configured" should not be construed to mean that a given element, component, or other subject matter is simply "capable of" performing a given function but that the element, component, and/or other subject matter is specifically selected, created, implemented, utilized, programmed, and/or designed for the purpose of performing the function. It is also within the scope of the present disclosure that elements, components, and/or other recited subject matter that is recited as being adapted to perform a particular function may additionally or alternatively be described as being configured to perform that function, and vice versa.

As used herein, the phrase, "for example," the phrase, "as an example," and/or simply the term "example," when used with reference to one or more components, features, details, structures, embodiments, and/or methods according to the present disclosure, are intended to convey that the described component, feature, detail, structure, embodiment, and/or method is an illustrative, non-exclusive example of components, features, details, structures, embodiments, and/or methods according to the present disclosure. Thus, the described component, feature, detail, structure, embodiment, and/or method is not intended to be limiting, required, or exclusive/exhaustive; and other components, features, details, structures, embodiments, and/or methods, including structurally and/or functionally similar and/or equivalent components, features, details, structures, embodiments, and/or methods, are also within the scope of the present disclosure.

As used herein, "at least substantially," when modifying a degree or relationship, may include not only the recited "substantial" degree or relationship, but also the full extent of the recited degree or relationship. A substantial amount of a recited degree or relationship may include at least 75% of the recited degree or relationship. For example, an object that is at least substantially formed from a material includes objects for which at least 75% of the objects are formed from the material and also includes objects that are completely formed from the material. As another example, a first length that is at least substantially as long as a second length includes first lengths that are within 75% of the second length and also includes first lengths that are as long as the second length.

Illustrative, non-exclusive examples of handheld projectile weapons, grips and methods, according to the present disclosure, are presented in the following enumerated paragraphs. It is within the scope of the present disclosure that an individual step of a method recited herein, including in the following enumerated paragraphs, may additionally or alternatively be referred to as a "step for" performing the recited action.

A1. A grip for a handheld projectile weapon, the grip comprising at least one of:

a grip frame, wherein the grip frame includes a frame keyed region, a frame fastener receptacle, and optionally, an attachment structure, which is configured to facilitate attachment of the grip frame to the handheld projectile weapon;

a frame cover configured to be operatively attached to the grip frame, to cover a corresponding region of the grip frame, and to at least partially define a grip surface of the grip, which is shaped to be held by a user of the handheld projectile weapon, wherein the frame cover includes a cover keyed region, which is shaped to slidingly engage with the frame keyed region along an engagement axis and to resist separation of the frame cover from the grip frame in any direction that is not parallel to the engagement axis, and a cover fastener receptacle positioned to align with the frame fastener receptacle while the cover keyed region is slidingly engaged with the frame keyed region; and optionally, a fastener that extends through both the frame fastener receptacle and the cover fastener receptacle to resist relative motion between the grip frame and the frame cover.

A2. The grip of paragraph A1, wherein the grip includes, or is, a pistol grip.

A3. The grip of any of paragraphs A1-A2, wherein the grip includes, or is, a fore grip, or a vertical fore grip.

A4. The grip of any of paragraphs A1-A3, wherein the grip includes, or is, at least one of a forend and a handguard.

A5. The grip of any of paragraphs A1-A4, wherein the grip frame is defined by a frame material that includes at least one of a metallic frame material, a composite frame material, and a polymeric frame material.

A6. The grip of any of paragraphs A1-A5, wherein the frame fastener receptacle is a cylindrical, or at least substantially cylindrical, frame fastener receptacle.

A7. The grip of any of paragraphs A1-A6, wherein a bore axis of the frame fastener receptacle extends at least one of:

(i) perpendicular, or at least substantially perpendicular, to the engagement axis; and (ii) parallel, or at least substantially parallel, to the engagement axis.

A8. The grip of any of paragraphs A1-A7, wherein the frame fastener receptacle is positioned within a region of the grip that is covered by at least one of a palm of the user and fingers of the user when the grip is held by the user.

A9. The grip of any of paragraphs A1-A8, wherein the attachment structure includes an attachment fastener receptacle configured to receive an attachment fastener that operatively attaches the grip frame to the handheld projectile weapon.

A10. The grip of any of paragraphs A1-A9, wherein the attachment structure includes at least one of an attachment projection and an attachment recess, shaped to be received within the other of the attachment projection and the attachment recess, that is defined by the handheld projectile weapon.

A11. The grip of any of paragraphs A1-A10, wherein the frame cover is defined by a cover material that includes at least one of a metallic cover material, a polymeric cover material, a composite cover material, a naturally occurring cover material, and a wooden cover material.

A12. The grip of any of paragraphs A1-A11, wherein the cover fastener receptacle is a cylindrical, or at least substantially cylindrical, cover fastener receptacle.

A13. The grip of any of paragraphs A1-A12, wherein a bore axis of the cover fastener receptacle extends perpendicular, or at least substantially perpendicular, to the engagement axis.

A14. The grip of any of paragraphs A1-A13, wherein the cover fastener receptacle is positioned within a region of the grip that is covered by at least one of a/the palm of the user and the user's fingers when the grip is held by the user.

A15. The grip of any of paragraphs A1-A14, wherein the grip surface includes a plurality of concave recesses shaped to provide a positive and comfortable grip for the user.

A16. The grip of paragraph A15, wherein the plurality of concave recesses is shaped like at least one of fish scales and snake scales.

A17. The grip of any of paragraphs A15-A16, wherein each concave recess of the plurality of concave recesses defines an at least partially arcuate outer perimeter.

A18. The grip of any of paragraphs A15-A17, wherein at least one of a maximum extent, a diameter, an effective diameter, an average maximum extent, an average diameter, and an average effective diameter of the plurality of concave recesses is at least one of:

(i) at least 10 millimeters (mm), at least 12 mm, at least 14 mm, at least 16 mm, at least 18 mm, at least 20 mm, at least 22 mm, at least 24 mm, at least 26 mm, at least 28 mm, at least 30 mm, at least 32 mm, at least 34 mm, at least 36 mm, at least 38 mm, at least 40 mm, at least 42 mm, at least 44 mm, at least 46 mm, at least 48 mm, or at least 50 mm; and (ii) at most 60 mm, at most 55 mm, at most 50 mm, at most 45 mm, at most 40 mm, at most 35 mm, at most 30 mm, at most 25 mm, at most 20 mm, or at most 15 mm.

A19. The grip of any of paragraphs A1-A18, wherein:

(i) the frame cover is a first frame cover;

(ii) the cover keyed region is a first cover-keyed region;

(iii) the cover fastener receptacle is a first cover-fastener receptacle;

(iv) the grip further includes a second frame cover that includes a second cover-keyed region and a second cover-fastener receptacle;

(v) the frame keyed region is a first frame-keyed region, and the grip frame further includes a second frame-keyed region;

(vi) the engagement axis is a first engagement axis and the second cover keyed-region is shaped to slidingly engage with the second frame-keyed region along a second engagement axis, and to resist separation of the second frame cover from the grip frame in any direction that is not parallel to the second engagement axis, and (vii) the second cover-fastener receptacle is positioned to align with the frame fastener receptacle, while the second cover-keyed region is slidingly engaged with the second frame-keyed region.

A20. The grip of paragraph A19, wherein the first engagement axis is spaced-apart from the second engagement axis.

A21. The grip of any of paragraphs A19-A20, wherein the first engagement axis is parallel, or at least substantially parallel, to the second engagement axis.

A22. The grip of any of paragraphs A19-A21, wherein the first frame-keyed region and the second frame-keyed region are on opposed sides of the grip frame.

A23. The grip of any of paragraphs A19-A22, wherein the first frame cover and the second frame cover define opposed sides of the grip when the first frame cover is slidingly engaged with the first frame-keyed region, and the second frame cover is slidingly engaged with the second frame-keyed region.

A24. The grip of any of paragraphs A1-A23, wherein the frame keyed region includes one of a male keyed region and a female keyed region, wherein the cover keyed region includes the other of the male keyed region and the female keyed region, and further wherein the female keyed region is configured to receive the male keyed region along the engagement axis.

A25. The grip of paragraph A24, wherein the frame keyed region includes one of a keyed region projection and a keyed region recess, wherein the cover keyed region includes the other of the keyed region projection and the keyed region recess, and further wherein the keyed region recess is configured to receive the keyed region projection along the engagement axis.

A26. The grip of any of paragraphs A1-A25, wherein the frame keyed region is a dovetail-shaped frame keyed region, and further wherein the cover keyed region is a dovetail-shaped cover keyed region, which is configured to receive the dovetail-shaped frame keyed region along the engagement axis.

A27. The grip of any of paragraphs A1-A26, wherein the dovetail-shaped frame keyed region is one of a dovetail-shaped projection and a dovetail-shaped recess, and further wherein the cover keyed region is the other of the dovetail-shaped projection and the dovetail-shaped recess.

A28. The grip of any of paragraphs A1-A27, wherein one of the frame keyed region and the cover keyed region is shaped to be slidingly received within the other of the frame keyed region and the cover keyed region along the engagement axis.

A29. The grip of any of paragraphs A1-A28, wherein the frame keyed region and the cover keyed region together define a stop that is configured to define an engaged orientation between the grip frame and the frame cover along the engagement axis.

A30. The grip of paragraph A29, wherein, when in the engaged orientation, a/the bore axis of the frame fastener receptacle is aligned, or at least substantially aligned, with a/the bore axis of the cover fastener receptacle.

A31. The grip of any of paragraphs A1-A30, wherein the fastener includes a screw.

A32. The grip of any of paragraphs A1-A31, wherein the fastener is configured to thread into a corresponding frame-threaded region of the frame fastener receptacle.

B1. A handheld projectile weapon, comprising:

optionally, a barrel;

an action; and the grip of any of paragraphs A1-A32.

B2. The handheld projectile weapon of paragraph B1, wherein the handheld projectile weapon includes at least one of:

(i) a firearm;

(ii) a rifle;

(iii) a modern sporting rifle;

(iv) a shotgun;

(v) a handgun;

(vi) a speargun;

(vii) a paintball gun;

(viii) a crossbow, and (ix) an airsoft gun.

C1. A method of assembling a grip for a handheld projectile weapon, the method comprising:

aligning a cover keyed region of a frame cover of the grip with a frame keyed region of a grip frame of the grip;

engaging the frame cover with the grip frame by translating the frame cover and the grip frame relative to one another along an engagement axis, such that the cover keyed region and the frame keyed region engage with one another and resist relative motion between the frame cover and the grip frame in any direction that is not parallel to the engagement axis; and positioning a single fastener within both a frame fastener receptacle of the grip frame and a cover fastener receptacle of the frame cover to operatively attach the frame cover to the grip frame, and resist relative motion between the frame cover and the grip frame along the engagement axis.

C2. The method of paragraph C1, wherein the grip includes any suitable structure, function, and/or feature of any of the grips of any of paragraphs A1-A32.

INDUSTRIAL APPLICABILITY

The grips, handheld projectile weapons, and methods disclosed herein are applicable to the handheld projectile weapon manufacture and accessory industries.

It is believed that the disclosure set forth above encompasses multiple distinct inventions with independent utility. While each of these inventions has been disclosed in its preferred form, the specific embodiments thereof as disclosed and illustrated herein are not to be considered in a limiting sense as numerous variations are possible. The subject matter of the inventions includes all novel and non-obvious combinations and subcombinations of the various elements, features, functions and/or properties disclosed herein. Similarly, where the claims recite "a" or "a first" element or the equivalent thereof, such claims should be understood to include incorporation of one or more such elements, neither requiring nor excluding two or more such elements.

It is believed that the following claims particularly point out certain combinations and subcombinations that are directed to one of the disclosed inventions and are novel and non-obvious. Inventions embodied in other combinations and subcombinations of features, functions, elements and/or properties may be claimed through amendment of the present claims or presentation of new claims in this or a related application. Such amended or new claims, whether they are directed to a different invention or directed to the same invention, whether different, broader, narrower, or equal in scope to the original claims, are also regarded as included within the subject matter of the inventions of the present disclosure.

The invention claimed is:

1. A grip for a handheld projectile weapon, the grip comprising:

a grip frame, wherein the grip frame includes a frame keyed region, a frame fastener receptacle, and an attachment structure that attaches the grip frame to the handheld projectile weapon;

a frame cover configured to be operatively attached to the grip frame, to cover a corresponding region of the grip frame, and to at least partially define a grip surface of the grip, which is shaped to be held by a user of the handheld projectile weapon, wherein the frame cover includes a cover keyed region, which is shaped to slidingly engage with the frame keyed region along an engagement axis and to resist separation of the frame cover from the grip frame in any direction that is not parallel to the engagement axis, and a cover fastener receptacle positioned to align with the frame fastener receptacle while the cover keyed region is slidingly engaged with the frame keyed region, wherein the frame keyed region and the cover keyed region together define a stop that is configured to define an engaged orientation between the grip frame and the frame cover along the engagement axis, wherein, when in the engaged orientation, a bore axis of the frame fastener receptacle is at least substantially aligned with a bore axis of the cover fastener receptacle; and a fastener that extends through both the frame fastener receptacle and the cover fastener receptacle to resist relative motion between the grip frame and the frame cover.

2. The grip of claim 1, wherein the grip is a pistol grip.

3. The grip of claim 1, wherein the grip is a fore grip.

4. The grip of claim 1, wherein a bore axis of the frame fastener receptacle and a bore axis of the cover fastener receptacle extend at least substantially perpendicular to the engagement axis.

5. The grip of claim 1, wherein the cover fastener receptacle is positioned within a region of the grip that is covered by at least one of a palm of the user and fingers of the user when the grip is held by the user.

6. The grip of claim 1, wherein the grip surface includes a plurality of concave recesses shaped to provide a positive and comfortable grip for the user.

7. The grip of claim 6, wherein the plurality of concave recesses is shaped to resemble at least one of:

(i) fish scales; and (ii) snake scales.

8. The grip of claim 6, wherein each concave recess of the plurality of concave recesses defines an at least partially arcuate outer perimeter.

9. The grip of claim 6, wherein an average effective diameter of the plurality of concave recesses is at least 10 millimeters (mm) and at most 60 mm.

10. The grip of claim 1, wherein:

(i) the frame cover is a first frame cover;

(ii) the cover keyed region is a first cover-keyed region;

(iii) the cover fastener receptacle is a first cover-fastener receptacle;

(iv) the grip further includes a second frame cover that includes a second cover-keyed region and a second cover-fastener receptacle;

(v) the frame keyed region is a first frame-keyed region, and the grip frame further includes a second frame-keyed region;

(vi) the engagement axis is a first engagement axis, and the second cover-keyed region is shaped to slidingly engage with the second frame-keyed region along a second engagement axis, and to resist separation of the second frame cover from the grip frame in any direction that is not parallel to the second engagement axis, and (vii) the second cover-fastener receptacle is positioned to align with the frame fastener receptacle, while the second cover-keyed region is slidingly engaged with the second frame-keyed region.

11. The grip of claim 10, wherein the first engagement axis is spaced-apart from the second engagement axis, and further wherein the first engagement axis is at least substantially parallel to the second engagement axis.

12. The grip of claim 10, wherein the first frame-keyed region and the second frame-keyed region are on opposed sides of the grip frame, and further wherein the first frame cover and the second frame cover define opposed sides of the grip when the first frame cover is slidingly engaged with the first frame-keyed region and the second frame cover is slidingly engaged with the second frame-keyed region.

13. The grip of claim 1, wherein the frame keyed region includes one of a male keyed region and a female keyed region, wherein the cover keyed region includes the other of the male keyed region and the female keyed region, and further wherein the female keyed region is configured to receive the male keyed region along the engagement axis.

14. The grip of claim 13, wherein the frame keyed region includes one of a keyed region projection and a keyed region recess, wherein the cover keyed region includes the other of the keyed region projection and the keyed region recess, and further wherein the keyed region recess is configured to receive the keyed region projection along the engagement axis.

15. The grip of claim 1, wherein the frame keyed region is a dovetail-shaped frame keyed region, and further wherein the cover keyed region is a dovetail-shaped cover keyed region, which is configured to receive the dovetail-shaped frame keyed region along the engagement axis.

16. A handheld projectile weapon, comprising:

a barrel;

an action; and the grip of claim 1.

17. A method of assembling a grip for a handheld projectile weapon, the method comprising:

aligning a cover keyed region of a frame cover of the grip with a frame keyed region of a grip frame of the grip;

engaging the frame cover with the grip frame by translating the frame cover and the grip frame relative to one another along an engagement axis, such that the cover keyed region and the frame keyed region engage with one another and resist relative motion between the frame cover and the grip frame in any direction that is not parallel to the engagement axis, wherein the translating includes translating until the cover keyed region and the frame keyed region contact one another to define a stop that defines a predetermined engaged orientation between the frame cover and the grip frame, wherein, when in the predetermined engaged orientation, a bore axis of a frame fastener receptacle of the grip frame is at least substantially aligned with a bore axis of a cover fastener receptacle of the frame cover; and positioning a single fastener within both the frame fastener receptacle and the cover fastener receptacle to operatively attach the frame cover to the grip frame and resist relative motion between the frame cover and the grip frame along the engagement axis.

18. The method of claim 17, wherein, during the positioning, the bore axis of the frame fastener receptacle and the bore axis of the cover fastener receptacle extend at least substantially perpendicular to the engagement axis.

19. A grip for a handheld projectile weapon, the grip comprising:

a grip frame, wherein the grip frame includes a frame keyed region, a frame fastener receptacle, and an attachment structure that attaches the grip frame to the handheld projectile weapon;

a frame cover configured to be operatively attached to the grip frame, to cover a corresponding region of the grip frame, and to at least partially define a grip surface of the grip, which is shaped to be held by a user of the handheld projectile weapon, wherein the frame cover includes a cover keyed region, which is shaped to slidingly engage with the frame keyed region along an engagement axis and to resist separation of the frame cover from the grip frame in any direction that is not parallel to the engagement axis, and a cover fastener receptacle positioned to align with the frame fastener receptacle while the cover keyed region is slidingly engaged with the frame keyed region, and further wherein a bore axis of the frame fastener receptacle and a bore axis of the cover fastener receptacle extend at least substantially parallel to the engagement axis; and a fastener that extends through both the frame fastener receptacle and the cover fastener receptacle to resist relative motion between the grip frame and the frame cover.

20. The grip of claim 19, wherein the grip is a fore grip.

* * * * *